US005617315A

United States Patent [19]

Nakao et al.

[11] Patent Number: 5,617,315

[45] Date of Patent: Apr. 1, 1997

[54] ACTIVE VIBRATION DAMPING SYSTEM FOR A VEHICLE

[75] Inventors: Norihiko Nakao; Yutaka Tukahara; Naoki Ikeda; Shin Takehara; Hirofumi Seni; Shingo Harada; Chiaki Santo, all of Hiroshima-ken, Japan

[73] Assignee: Mazda Motor Corporation, Hiroshima-ken, Japan

[21] Appl. No.: 111,470

[22] Filed: Aug. 25, 1993

[30] Foreign Application Priority Data

| | | | |
|---|---|---|---|
| Aug. 31, 1992 | [JP] | Japan | 4-230749 |
| Sep. 7, 1992 | [JP] | Japan | 4-238169 |
| Aug. 6, 1993 | [JP] | Japan | 5-195744 |

[51] Int. Cl.[6] ..... G10K 11/16

[52] U.S. Cl. ..... 364/424.045; 364/508; 364/574; 280/707; 381/71; 381/94

[58] Field of Search ..... 364/424.01, 424.05, 364/508, 574; 280/707; 381/71, 86, 94

[56] References Cited

U.S. PATENT DOCUMENTS

| | | | |
|---|---|---|---|
| 4,435,751 | 3/1984 | Hori et al. | 364/574 |
| 4,947,356 | 8/1990 | Elliott et al. | 364/574 |
| 5,148,402 | 9/1992 | Magliozzi | 364/574 |
| 5,233,540 | 8/1993 | Andersson et al. | 364/508 |
| 5,245,552 | 9/1993 | Andersson et al. | 364/508 |

FOREIGN PATENT DOCUMENTS

| | | |
|---|---|---|
| 0479367 | 4/1992 | European Pat. Off. . |
| 2201858 | 9/1988 | United Kingdom . |
| 88/02912 | 4/1988 | WIPO . |
| 92/08225 | 5/1992 | WIPO . |

*Primary Examiner*—Collin W. Park

*Attorney, Agent, or Firm*—Sixbey, Friedman, Leedom & Ferguson, P.C.; Gerald J. Ferguson, Jr.; Donald R. Studebaker

[57] ABSTRACT

A vibration damping system for a vehicle has a vibration sensor which detects vibration of solid elements on the vehicle and vibration of air inside the vehicle. A first vibrator supports a power unit relative to the vehicle body and directly vibrates the vehicle body. A second vibrator directly vibrates air inside the vehicle body. A drive control unit performs calculation on the basis of a detecting signal from the vibration sensor and controls the first and the second vibrators on the basis of the result of the calculation so that the vibration of the solid element and the vibration of air inside the vehicle body are damped. The vibrator control ratio of the first and second vibrators is changed according to the condition of a predetermined factor of the vehicle.

28 Claims, 23 Drawing Sheets

ACTIVE VIBRATION DAMPING SYSTEM FOR A VEHICLE

BACKGROUND OF THE INVENTION

1. Field of the Invention

This invention relates to a vibration damping system for a vehicle for damping vibration of a particular vibrating element such as the vehicle body, air in the cabin or the like mainly generated by vibration of a power unit, and more particularly to a vibration damping system for a vehicle which has a vibrator for vibrating the particular vibrating element and vibrates the particular vibrating element in the phase reverse to that of the vibration of the particular vibrating element and in the amplitude equal to that of the vibration of the same, thereby damping the vibration of the vehicle body or air in the cabin (noise).

2. Description of the Prior Art

As disclosed in Japanese Unexamined Patent Publication No. 1(1989)-501344, there has been known a vibration damping system for a vehicle comprising, in addition to the vibrator, a vibration sensor which detects vibration of a particular vibrating element on the vehicle body and a drive control means which performs calculation on the basis of the detecting signal from the vibration sensor and causes the vibrator to vibrate the particular vibrating element so that the vibration of the particular vibrating element is damped. In such vibration damping systems, there are those in which an optimization technique is employed in the calculation performed by the drive control means as in the vibration damping system disclosed in the above identified patent publication and there are those in which the optimization technique is not employed. The former systems are generally arranged as shown in FIG. 33.

The vibration damping system shown in FIG. 33 is for damping vibration of air in the cabin (noise) generated due to vibration of an engine E (as the power unit) and comprises a plurality of microphones 2 (m in number) which are disposed in predetermined positions in the cabin and detect vibration of air in the respective predetermined positions, a plurality of speakers 4 (i in number) which are disposed in predetermined positions in the cabin and vibrate air in the cabin to damp the vibration of air, and a drive control means 6 which generates drive signals $y_1$ to $y_i$ for controlling the speakers 4. The vibration damping system is further provided with a reference signal generating means 8 which detects an ignition pulse signal w, generated in relation to the revolution speed of the engine E, from an ignition coil 24 and shapes the waveform of the ignition pulse signal w, thereby generating a reference signal x.

The microphones 2 detect the vibration due to the vibration of the engine E together with the vibration generated by the speakers 4 and output the result of the detection as detecting signals $e_1$ to $e_m$. The detecting signals $e_1$ to $e_m$ are input into the drive control means 6 through amplifiers 16 and A/D convertors 18. The reference signal x generated by the reference signal generating means 8 is input into the drive control means 6 through an amplifier 12 and an A/D convertor 14.

The drive control means 6 comprises adaptive filters F1 to Fi which adjust the phase and the amplitude of the reference signal x and an adaptive algorithm section 10 which updates every moment the factors of the adaptive filters F1 to Fi so that the detecting signals $e_1$ to $e_m$ input from the microphones 2 are minimized, and outputs the signals passing through the adaptive filters F1 to Fi as the drive signals $y_1$ to $y_i$. As the adaptive algorithm for updating the factors of the adaptive filters F1 to Fi, there have been known Least Mean Square Method, Newton Method, Simplex Method, Powell Method and the like. In this example, Least Mean Square Method is employed. In Least Mean Square Method, the reference signal x is input into the adaptive algorithm section 10 through a digital filter $H^{\circ}_{IM}$ (I standing for 1, 2, . . . , i and M standing for 1, 2, . . . , m). The digital filter $H^{\circ}_{IM}$ is modeled on the transmission properties between I-th speaker 4 and M-th microphone 2 and the space distance between the speaker 4 and the microphone 2 is thus interpolated.

A spectral analysis shows that vibration of a power unit such as an engine includes many sinusoidal vibration components having frequencies of integral multiples of the engine rpm and that the vibration components have different levels and one or more particular components have especially high levels. By damping the vibration caused by the components of the vibration of the power unit at such high levels, a sufficient vibration damping effect can be obtained, and accordingly, control is generally effected with the aim of damping the vibration caused by the components of the vibration of the power unit at such high levels. For example, in the case of a vehicle having a four-cycle four-cylinder engine, the vibration component having a frequency of twice the engine speed (will be referred to as "the secondary component", hereinbelow) has an especially high level, and control is generally effected with intention of damping the vibration caused by the secondary component.

Though the vibration damping system described above is arranged to damp the vibration of air in the cabin (noise) caused by the engine vibration, solid elements of the vehicle body such as a frame of the vehicle body, panels of the vehicle body, seats, a steering wheel and the like are also caused to vibrate by the engine vibration. Accordingly it is preferred that not only the vibration of air in the cabin but also the vibration of the solid elements be damped. However the vibration damping system having speakers and microphones respectively as the vibrators and the vibration sensors cannot damp the vibration of the solid elements though can damp the vibration of air.

On the other hand, in the case of vibration damping system disclosed, for instance, in Japanese Unexamined Patent Publication No. 3(1991)-219139 having an engine mount which supports the engine relative to the vehicle body and also functions as a vibrator for vibrating engine (will be referred to as "the vibrating engine mount", hereinbelow) and an acceleration sensor which functions as the vibration sensor cannot damp the vibration of air with a high efficiency though can damp the vibration of the solid elements with a high efficiency.

It may be possible to satisfactorily damp both the vibration of air and the vibration of the solid elements by providing both a speaker and a vibrating engine mount and controlling them.

However when the number of the kinds of vibrators is simply increased, the load on the drive control means in calculation is increased in vain or electric power consumption to drive the vibrators excessively increases, which results in inefficient vibration damping effect.

SUMMARY OF THE INVENTION

In view of the foregoing observations and description, the primary object of the present invention is to provide a vibration damping system for a vehicle which can damp satisfactorily and efficiently both the vibration of air and the vibration of the solid elements caused by the vibration of the power unit.

In one aspect of the present invention, there is provided a vibration damping system for a vehicle comprising a vibration detecting means which detects vibration of solid elements on the vehicle and vibration of air inside the vehicle, a first vibrator which supports a power unit relative to the vehicle body and directly vibrates the vehicle body, a second vibrator which directly vibrates air inside the vehicle body, a drive control means which performs calculation on the basis of a detecting signal from the vibration detecting means and controls the first and the second vibrators on the basis of the result of the calculation so that the vibration of the solid element and the vibration of air inside the vehicle body are damped, and a ratio changing means which changes the vibrator control ratio of the first and second vibrators according to the condition of a predetermined factor of the vehicle.

The term "solid elements" means vehicle body components such as a frame of the vehicle body, panels of the vehicle body, seats, a steering wheel and the like.

The term "power unit" means an engine, a transmission and/or the like.

The vibration detecting means may be a vibration sensor which can detect both the vibration of the solid element and the vibration of air inside the vehicle body, or may be a combination of a vibration sensor which can detect the vibration of the solid element and vibration sensor which can detect the vibration of air inside the vehicle body.

In one embodiment of the present invention, the vibrator control ratio is changed by changing the ratio of the part of the operational power of the drive control means allotted to the control of the first vibrator to the part of the operational power of the drive control means allotted to the control of the second vibrator.

In another embodiment of the present invention, the vibrator control ratio is changed by changing the ratio of the proportion of the amount of the vibration of the first vibrator set by the drive control means to the amount of the vibration of the first vibrator optimal to damp the vibration of the solid element to the proportion of the amount of the vibration of the second vibrator set by the drive control means to the amount of the vibration of the second vibrator optimal to damp the vibration of the air inside the vehicle body.

The term "the amount of the vibration of the first vibrator optimal to damp the vibration of the solid element" or "the amount of the vibration of the second vibrator optimal to damp the vibration of the air inside the vehicle body" means the amount of the vibration by which the vibrator is to be vibrated to optimally damp the vibration of the solid element or air inside the vehicle.

Said predetermined factor of the vehicle may be the engine speed, the vehicle speed, the loudness of the audio system on the vehicle, the degree of opening of the window, the number of the passengers on the vehicle, the level of noise included in the detecting signal from the vibration detecting means, the electric load, the acceleration and deceleration of the vehicle, the air flow of an air-conditioner on the vehicle, whether the vibrators are in the normal condition or in an abnormal condition, the vibration of the power unit or the like.

The vibration damping system of the present invention may be further provided with a manual ratio setting means for manually setting the vibrator control ratio.

In another aspect of the present invention, there is provided a vibration damping system for a vehicle comprising a vibration detecting means which detects vibration of solid elements on the vehicle and vibration of air inside the vehicle, a vibrator group consisting of a first vibrator which supports a power unit relative to the vehicle body and directly vibrates the vehicle body and a second vibrator which directly vibrates air inside the vehicle body, and a drive control means which performs calculation on the basis of a detecting signal from the vibration detecting means and outputs a single drive signal to the vibrator group on the basis of the result of the calculation, the first and the second vibrators forming the vibrator group being driven by the single drive signal for the vibrator group so that the vibration of the solid element and the vibration of air inside the vehicle body are damped.

In still another aspect of the present invention, there is provided a vibration damping system for a vehicle comprising a vibration detecting means which detects vibration of solid elements on the vehicle and vibration of air inside the vehicle, a vibrator group consisting of a first vibrator which supports a power unit relative to the vehicle body and directly vibrates the vehicle body and a second vibrator which directly vibrates air inside the vehicle body, a drive control means which performs calculation on the basis of a detecting signal from the vibration detecting means and outputs a single drive signal to the vibrator group on the basis of the result of the calculation which drive signal drives the first and the second vibrators forming the vibrator group so that the vibration of the solid element and the vibration of air inside the vehicle body are damped, and a drive signal separating means which separates the drive signal by frequency into first and second drive signals for the first and second vibrators forming the vibrator group, the first and second vibrators forming the vibrator group being driven respectively by the first and second drive signals.

In still another aspect of the present invention, there is provided a vibration damping system for a vehicle comprising a vibration sensor group consisting of a first vibration sensor which detects vibration of solid elements on the vehicle and a second vibration sensor which detects vibration of air inside the vehicle, a vibrator group consisting of a first vibrator which supports a power unit relative to the vehicle body and directly vibrates the vehicle body and a second vibrator which directly vibrates air inside the vehicle body, a detecting signal mixing means which mixes detecting signals of the first and second vibration sensors into a detecting signal, and a drive control means which performs calculation on the basis of the detecting signal from the detecting signal mixing means and outputs a single drive signal to the vibrator group on the basis of the result of the calculation which single drive signal drives the first and the second vibrators forming the vibrator group so that the vibration of the solid element and the vibration of air inside the vehicle body are damped, the first and second vibrators forming the vibrator group being driven by the single drive signal.

In still another aspect of the present invention, there is provided a vibration damping system for a vehicle comprising a vibration sensor group consisting of a first vibration sensor which detects vibration of solid elements on the vehicle and a second vibration sensor which detects vibration of air inside the vehicle, a vibrator group consisting of a first vibrator which supports a power unit relative to the vehicle body and directly vibrates the vehicle body and a second vibrator which directly vibrates air inside the vehicle body, a detecting signal mixing means which mixes detecting signals of the first and second vibration sensors into a detecting signal, a drive control means which performs calculation on the basis of the detecting signal from the detecting signal mixing means and outputs a single drive signal to the vibrator group on the basis of the result of the calculation which drive signal drives the first and the second vibrators forming the vibrator group so that the vibration of the solid element and the vibration of air inside the vehicle body are damped, and a drive signal separating means which separates the single drive signal by frequency into first and second drive signals for the first and second vibrators forming the vibrator group, the first and second vibrators forming the vibrator group being driven respectively by the first and second drive signals.

In the vibration damping system of the present invention, the vibration of the solid element is damped by the first vibrator and the noise in the cabin is damped by the second vibrator. Accordingly, both the vibration of the solid element and the noise in the cabin can be effectively damped. At the same time, since the vibrator control ratio is changed according to a predetermined factor of the vehicle, an optimal damping of the vibration of the solid element and the noise in the cabin can be realized.

For example, when the vibrator control ratio is changed by changing the ratio of the part of the operational power of the drive control means allotted to the control of the first vibrator to the part of the operational power of the drive control means allotted to the control of the second vibrator, one of the vibration of the solid element and the noise in the cabin which is to be preferentially damped can be effectively damped without increasing the operational load on the drive control means. Further when the vibrator control ratio is changed by changing the ratio of the proportion of the amount of the vibration of the first vibrator set by the drive control means to the amount of the vibration of the first vibrator optimal to damp the vibration of the solid element to the proportion of the amount of the vibration of the second vibrator set by the drive control means to the amount of the vibration of the second vibrator optimal to damp the vibration of the air inside the vehicle body, the vibrator driving of which is not expected to result in satisfactory damping of the vibration is driven by an amount less than the amount optimal to damp the vibration, whereby electric power is saved.

Further when the first and second vibrators forming a vibrator group are driven by a single drive signal, the operational load on the drive control means can be reduced. Further when the drive signal separating means is provided and the single drive signal is separated by frequency into first and second drive signals for the first and second vibrators forming the vibrator group, generation of distortion in the first and second vibrators which can be generated when the drive signal for each vibrator includes a component which does not conform to the vibrator can be prevented.

Further when the detecting signals from first and second vibration sensors are mixed into a single signal and input into the drive control means, the operational load on the drive control means can be reduced.

DESCRIPTION OF THE PREFERRED EMBODIMENTS

Figure 33:
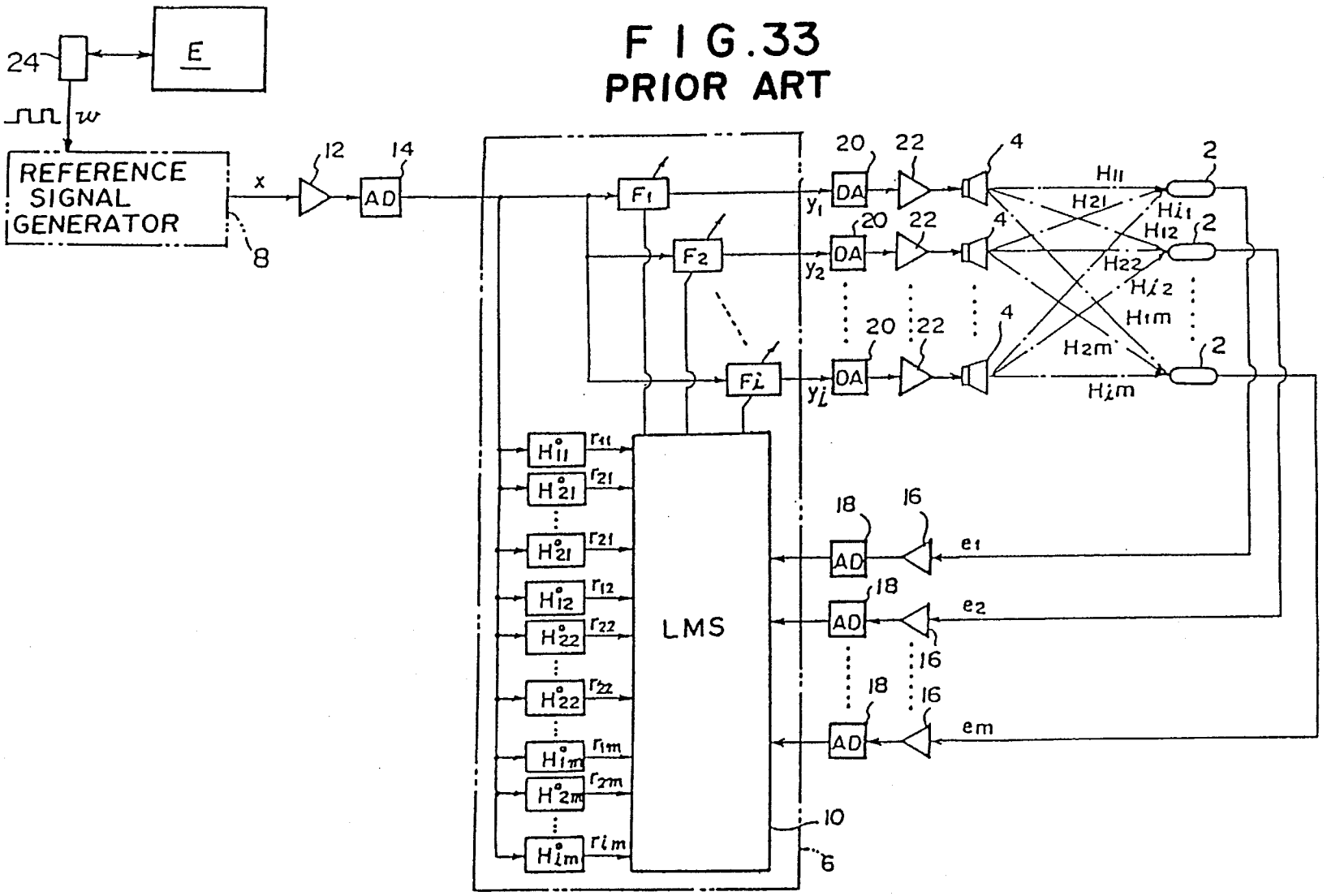
FIG. 33 PRIOR ART
FIG. 33 is a schematic view showing the structure of the controller employed in the vibration damping system in accordance with a prior art.

A first embodiment of the present invention will be described with reference to FIGS. 1 and 2, hereinbelow. In this embodiment, the elements analogous to those shown in FIG. 33 are given the same reference numerals and will not be described in detail here.

Figure 1:
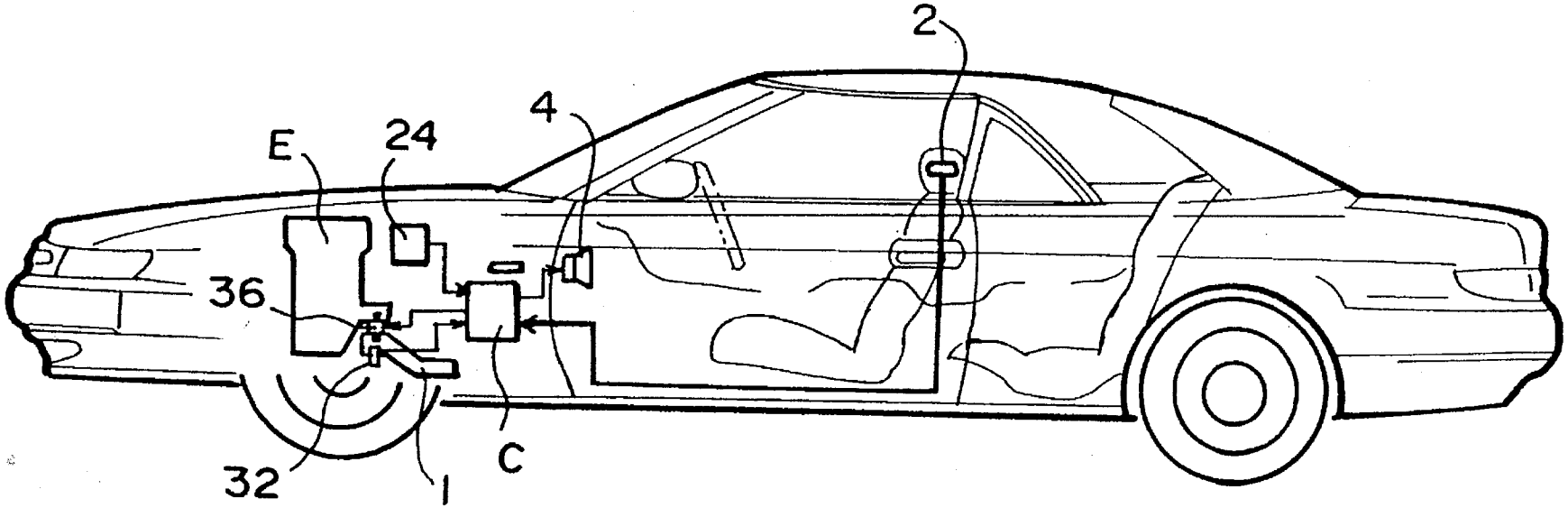
FIG. 1 is a schematic view showing a vehicle provided with a vibration damping system in accordance with a first embodiment of the present invention.

In FIG. 1, the vibration damping system of this embodiment comprises an acceleration sensor 32 (as a vibration sensor) which is disposed near the mounting portion of the engine E to the vehicle body 1 and detects the vibration of the vehicle body 1, a microphone 2 which is disposed near a seat in the cabin (preferably disposed near the ears of the passenger seated on the seats) and detects the vibration of air in the cabin, a vibrating engine mount 36 which supports the engine E relative to the vehicle body 1 and directly vibrates the vehicle body 1, a speaker 4 which is disposed in an instrument panel in the cabin and directly vibrates air in the cabin, and a controller C which drives the vibrating engine mount 36 and the speaker 4. Though in the illustrated embodiment, the acceleration sensor 32, the microphone 2, the vibrating engine mount 36 and the speaker 4 are each one in number, they may be plural in number.

Figure 2:
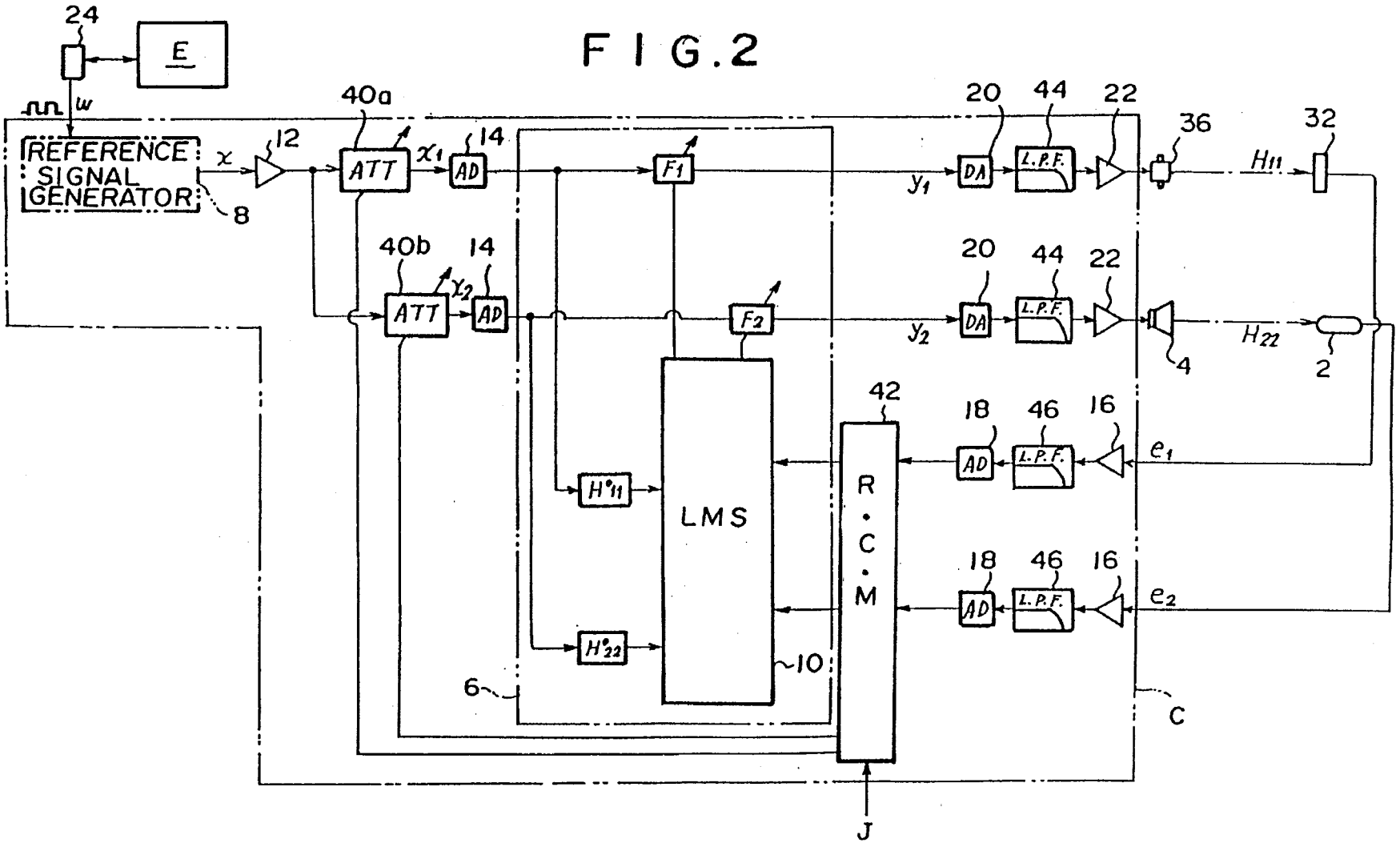
FIG. 2 is a schematic view showing the structure of the controller employed in the vibration damping system.

As shown in FIG. 2, the controller C comprises a reference signal generating means 8 which generates a reference signal x relating to the vibration of the engine E on the basis of an ignition pulse signal w generated by an ignition coil 24, attenuators 40*a* and 40*b* which attenuates the reference signal x input from the reference signal generating means 8 by a predetermined amount, a drive control means 6 which generates drive signals $y_1$ and $y_2$ for driving the vibrating engine mount 36 and the speaker 4 on the basis of the adjusted reference signals $x_1$ and $x_2$ output from the attenuators 40*a* and 40*b*, and a ratio changing means 42 which changes the attenuation rate of the reference signal x by the attenuators 40*a* and 40*b* and the control ratio of the vibrating engine mount 36 and the speaker 4 by the drive control means 6 according to the condition of a predetermined factor J. The drive control means 6 comprises adaptive filters $F_1$ and $F_2$ which adjust the phase and the amplitude of the adjusted reference signals $x_1$ and $x_2$ and an adaptive algorithm section 10 which adjusts the adaptive filters $F_1$ and $F_2$ so that the detecting signals $e_1$ to $e_2$ respectively input from the acceleration sensor 32 and the microphones 2 are minimized. In this embodiment, Least Mean Square Method is employed as the adaptive algorithm for adjusting the adaptive filters $F_1$ and $F_2$ and for this purpose, the drive control means 6 is provided with digital filters $H^{\circ}_{LM}$ (L standing for 1, 2 and M standing for 1, 2) which are modeled on the transmission properties between the vibrating engine mount 36 and the acceleration sensor 32 and between the speaker 4 and the microphone 2. Further the controller C has therein an amplifier 12 which amplifies the reference signal x, A/D convertors 14 which convert the adjusted reference signals $x_1$ and $x_2$ to digital signals, D/A convertors 20 which convert the drive signals $y_1$ and $y_2$ to analog signals, low-pass filters 44, amplifiers 22, amplifiers 16 which amplify the detecting signals $e_1$ and $e_2$, low-pass filters 46, and A/D convertors 18 which convert the detecting signals $e_1$ and $e_2$ passing through the low-pass filters 46 to digital signals.

In this embodiment, the ratio changing means 42 changes the vibrator control ratio by changing the input frequencies at which the detecting signals $e_1$ and $e_2$ from the acceleration sensor 32 and the microphone 2 are input into the drive control means 6 according to the condition of a predetermined factor J thereby changing the ratio of the part of the operational power of the drive control means 6 allotted to the control of the vibrating engine mount 36 to that allotted to the control of the speaker 4. Change of the vibrator control ratio by the ratio changing means 42 for various factors will be described, hereinbelow.

Figure 3A:
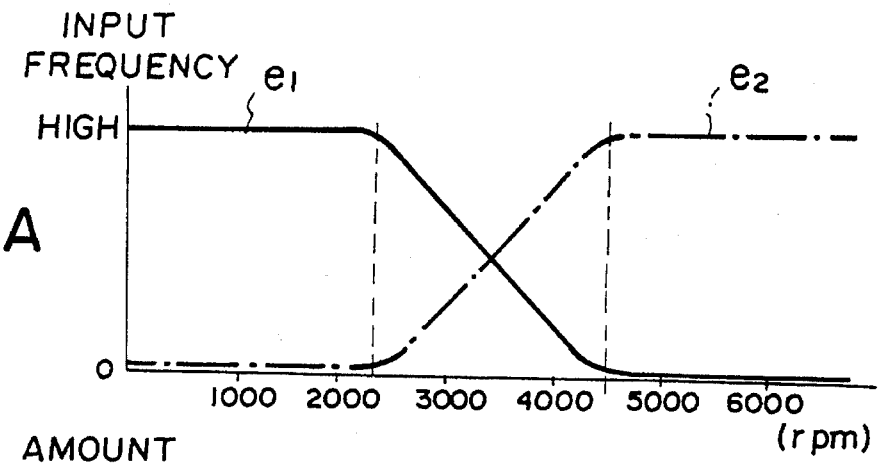
FIGS. 3A and 3B are views respectively showing the relation of the input frequencies of the detecting signals to the engine speed and the relation of the amount of the adjusted reference signals input into the drive control means to the engine speed when the ratio changing means changes the vibrator control ratio according to the engine speed, the broken lines in the drawings showing the correspondence therebeteween.
Figure 3B:
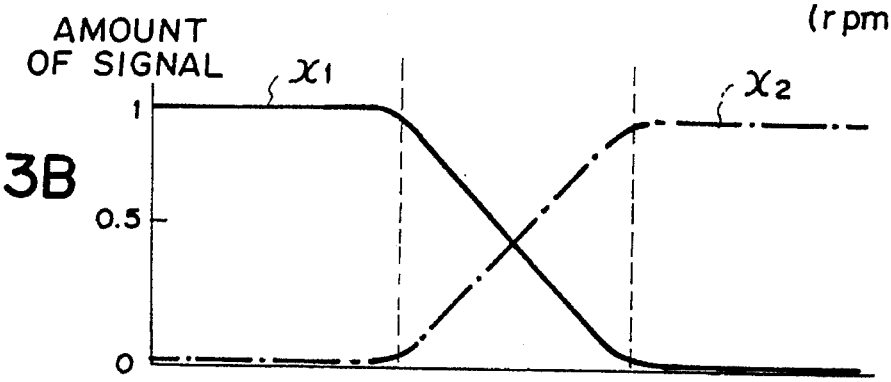

The case where the predetermined factor J is the engine speed, that is, the case where the ratio changing means 42 changes the vibrator control ratio according to the engine speed will be first described. FIGS. 3A and 3B respecively show the relation of the input frequencies of the detecting signals $e_1$ and $e_2$ to the engine speed and the relation of the amount of the adjusted reference signals $x_1$ and $x_2$ input into the drive control means to the engine speed.

Generally the level of vibration of the solid elements caused by vibration of the power unit is higher than that of air in the cabin when the engine speed is low and lower than the same when the engine speed is high.

As shown in FIGS. 3A and 3B, when the engine speed is in the low engine speed range, the ratio changing means 42 increases the input frequency of the detecting signal $e_1$ from the acceleration sensor 32 at which the detecting signal $e_1$ is input into the drive control means 6 in a predetermined time interval and nullifies the input frequency of the detecting signal $e_2$ from the microphone 2. Since the drive control means 6 performs calculation for updating the factor of the adaptive filters $F_1$ and $F_2$ according to the input frequencies of the detecting signals $e_1$ and $e_2$, all the operational power of the drive control means 6 is allotted to the control of the vibrating engine mount 36 when the input frequency of the detecting signal $e_1$ from the acceleration sensor 32 is increased and the input frequency of the detecting signal $e_2$ from the microphone 2 is nullified.

When the engine speed is in the middle engine speed range, the ratio changing means 42 reduces the input frequency of the detecting signal $e_1$ from the acceleration sensor 32 as the engine speed increases and increases the input frequency of the detecting signal $e_2$ from the microphone 2 as the engine speed increases. At the engine speed where the input frequencies of the detecting signals $e_1$ and $e_2$ are equal to each other, the operational power of the drive control means 6 is uniformly allotted to the control of the vibrating engine mount 36 and the control of the speaker 4.

When the engine speed is in the high engine speed range, the ratio changing means 42 nullifies the input frequency of the detecting signal $e_1$ from the acceleration sensor 32 and increases the input frequency of the detecting signal $e_2$ from the microphone 2. In this case, all the operational power of the drive control means 6 is allotted to the control of the speaker 4.

In addition to change of the input frequencies of the detecting signals $e_1$ and $e_2$, the ratio changing means 2 causes the attenuators 40*a* and 40*b* to increase the amount of the adjusted reference signal $x_1$ input into the adaptive filter $F_1$ (the reference signal x output from the amplifier 12 is input into the filter $F_1$ as it is without attenuation) and nullify the adjusted reference signal $x_2$ input into the adaptive filter $F_2$ in the low engine speed range, to gradually reduce the amount of the adjusted reference signal $x_1$ as the engine speed increases and gradually increase the adjusted reference signal $x_2$ as the engine speed increases in the middle engine speed range, and to nullify the adjusted reference signal $x_1$ and increase the amount of the adjusted reference signal $x_2$ in the high engine speed range.

The vibration damping system of this embodiment having the ratio changing means 42 which changes the input frequencies of the detecting signals $e_1$ and $e_2$ and amounts of the adjusted reference signals $x_1$ and $x_2$ input into the adaptive filters $F_1$ and $F_2$ in the manner described above operates as follows.

The acceleration sensor 32 shown in FIGS. 1 and 2 detects the vibration of the vehicle body 1 and outputs the detecting signal $e_1$ and the microphone 2 detects the vibration of air in the cabin (noise in the cabin) and outputs the detecting signal $e_2$. The detecting signals $e_1$ and $e_2$ are input into the drive control means 6 through the ratio changing means 42 which changes the input frequencies of the detecting signals $e_1$ and $e_2$ to the drive control means 6 according to the engine speed as described above.

When the engine speed is in the low engine speed range, the input frequency of the detecting signal $e_1$ is increased and the input frequency of the detecting signal $e_2$ is nullified. Since the drive control means 6 updates the factors of the adaptive filters $F_1$ and $F_2$ so that the signal levels are minimized each time the detecting signals $e_1$ and $e_2$ are input, the factor of the adaptive filter $F_2$ is not updated though the factor of the adaptive filter $F_1$ is updated and the signal level of the detecting signal $e_1$ is minimized. Whereas since the ratio changing means 42 increases the amount of the adjusted reference signal $x_1$ input into the adaptive filter $F_1$ and nullifies the amount of the adjusted reference signal $x_2$ input into the adaptive filter $F_2$ in the low engine speed range, no adjusted reference signal $x_2$ is input into the adaptive filter $F_2$ though the adjusted reference signals $x_1$ are successively input into the adaptive filter $F_1$. Accordingly the drive signals $y_1$ are successively generated to drive the vibrating engine mount 36 but no drive signal $y_2$ is generated and the speaker 4 is not driven. In this manner, when the engine speed is in the low engine speed range, damping of the vibration of the vehicle body 1 is preferentially effected and damping of the noise in the cabin is not effected. With this arrangement, in the low engine speed range where the vibration of the vehicle body 1 bothers the passengers more than the noise in the cabin, the vibration of the vehicle body 1 can be effectively damped well following the fluctuation thereof. Further since the input frequency of the detecting signal $e_2$ is nullified though the input frequency of the detecting signal $e_1$ is increased, the operational load on the drive control means 6 is not increased. Further since the speaker 4 driving of which will be almost useless in the low engine speed range is not driven, consumption of electric power can be suppressed.

On the other hand, in the high engine speed range where the noise in the cabin bothers the passengers more than the vibration of the vehicle body 1, the input frequency of the detecting signal $e_2$ is increased and the input frequency of the detecting signal $e_1$ is nullified, whereby the noise in the cabin can be effectively damped without increasing the operational load on the drive control means 6 and consumption of electric power can be suppressed by not driving the vibrating engine mount 36, driving of which will be almost useless in the high engine speed range.

In the lower side of the middle engine speed range, the vibration of the vehicle body 1 is damped in preference to the noise in the cabin and the degree of the preference is increased toward the low engine speed range, while in the higher side of the middle engine speed range, the noise in the cabin is damped in preference to the vibration of the vehicle body 1 and the degree of the preference is increased toward the high engine speed range. Also in the middle engine speed range, the vibration which more bothers the passengers is effectively damped without increasing the operational load on the drive control means 6.

Figure 4A:
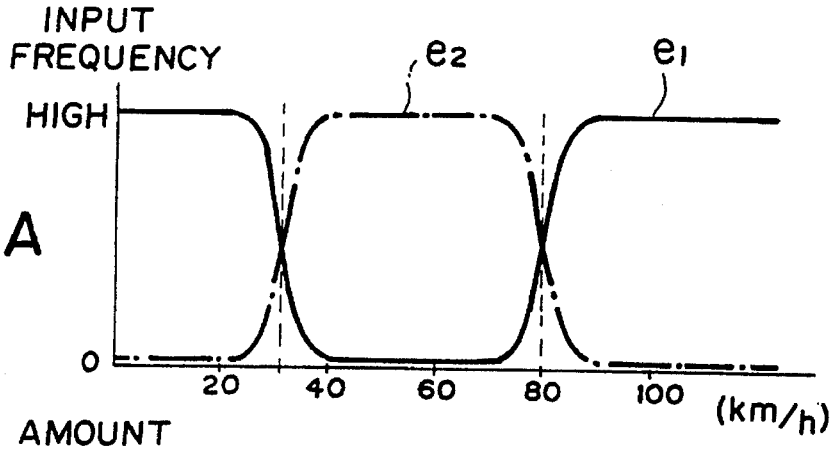
FIGS. 4A and 4B are views respectively showing the relation of the input frequencies of the detecting signals to the vehicle speed and the relation of the amount of the adjusted reference signals input into the drive control means to the vehicle speed when the ratio changing means changes the vibrator control ratio according to the vehicle speed.
Figure 4B:
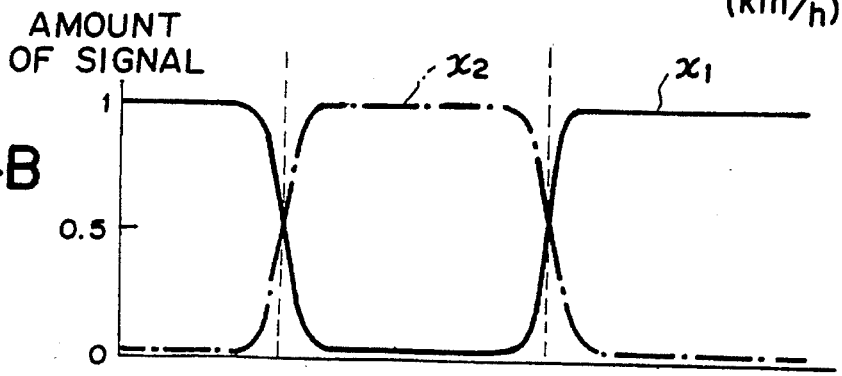

The case where the predetermined factor J is the vehicle speed, that is, the case where the ratio changing means 42 changes the vibrator control ratio according to the vehicle speed will be described, hereinbelow. FIGS. 4A and 4B respecively show the relation of the input frequencies of the detecting signals $e_1$ and $e_2$ to the vehicle speed and the relation of the amount of the adjusted reference signals $x_1$ and $x_2$ input into the drive control means 6 to the vehicle speed when the ratio changing means 42 changes the vibrator control ratio according to the vehicle speed.

Generally the level of vibration of the solid elements caused by vibration of the power unit is higher than that of air in the cabin when the vehicle speed is in a low speed range and lower than the same when the vehicle speed is in a high speed range. Further when the vehicle speed is in a highest speed range, the level of vibration of air due to external disturbances rather than to vibration of the power unit such as road noise, wind noise and the like prevails.

As shown in FIGS. 4A and 4B, when the vehicle speed is in the low speed range, the ratio changing means 42 increases the input frequency of the detecting signal $e_1$ from the acceleration sensor 32 and nullifies the input frequency of the detecting signal $e_2$ from the microphone 2, thereby allotting all the operational power of the drive control means 6 to the control of the vibrating engine mount 36.

When the vehicle speed is in the high speed range, the ratio changing means 42 nullifies the input frequency of the detecting signal $e_1$ from the acceleration sensor 32 and increases the input frequency of the detecting signal $e_2$ from the microphone 2, thereby allotting all the operational power of the drive control means 6 to the control of the speaker 4.

When the vehicle speed is in the highest speed range, the ratio changing means 42 increases the input frequency of the detecting signal $e_1$ from the acceleration sensor 32 and nullifies the input frequency of the detecting signal $e_2$ from the microphone 2, thereby allotting all the operational power of the drive control means 6 to the control of the vibrating engine mount 36.

In addition to change of the input frequencies of the detecting signals $e_1$ and $e_2$, the ratio changing means 42 causes the attenuators **40*a* and 40*b*** to increase the amount of the adjusted reference signal $x_1$ input into the adaptive filter $F_1$ and nullify the adjusted reference signal $x_2$ input into the adaptive filter $F_2$ in the low vehicle speed range, to nullify the adjusted reference signal $x_1$ and increase the amount of the adjusted reference signal $x_2$ in the high vehicle speed range, and to increase the amount of the adjusted reference signal $x_1$ input into the adaptive filter $F_1$ and nullify the adjusted reference signal $x_2$ input into the adaptive filter $F_2$ in the highest vehicle speed range.

In this embodiment, when the vehicle speed is in the low speed range, damping of the vibration of the vehicle body 1 is preferentially effected and damping of the noise in the cabin is not effected. With this arrangement, in the low vehicle speed range where the vibration of the vehicle body 1 bothers the passengers more than the noise in the cabin, the vibration of the vehicle body 1 can be effectively damped well following the fluctuation thereof. Further since the input frequency of the detecting signal $e_2$ is nullified though the input frequency of the detecting signal $e_1$ is increased, the operational load on the drive control means 6 is not increased. Further since the speaker 4 driving of which will be almost useless in the low vehicle speed range is not driven, consumption of electric power can be suppressed.

On the other hand, in the high vehicle speed range where the noise in the cabin bothers the passengers more than the vibration of the vehicle body 1, the input frequency of the detecting signal $e_2$ is increased and the input frequency of the detecting signal $e_1$ is nullified, whereby the noise in the cabin can be effectively damped without increasing the operational load on the drive control means 6 and consumption of electric power can be suppressed by not driving the vibrating engine mount 36, driving of which will be almost useless in the high vehicle speed range.

In the highest vehicle speed range, since the level of noise such as road noise, wind noise or the like which is not caused due to the vibration of the power unit increases and the microphone 2 detects the noise due to the vibration of the power unit together with the noise not due to the vibration of the power unit, satisfactory vibration damping effect cannot be obtained even if the speaker 4 is driven. On the other hand, since the acceleration sensor 32 does not detect the noise, the vibration of the vehicle body 1 can be satisfactorily damped by driving the vibrating engine mount 36. For this reason, in the highest vehicle speed range, damping of the vibration of the vehicle body 1 is preferentially effected. Thus in the highest vehicle speed range, the input frequency of the detecting signal $e_1$ is increased and the input frequency of the detecting signal $e_2$ is nullified, whereby the vibration of the vehicle body 1 can be effectively damped without increasing the operational load on the drive control means 6 and consumption of electric power can be suppressed by not driving the speaker 4, driving of which will be almost useless in the highest vehicle speed range.

Figure 5A:
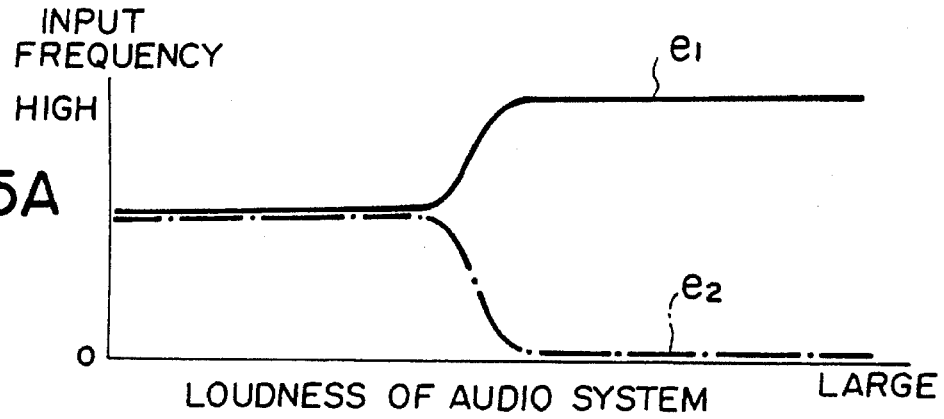
FIGS. 5A and 5B are views respectively showing the relation of the input frequencies of the detecting signals to the loudness of the audio system and the relation of the amount of the adjusted reference signals input into the drive control means to the loudness of the audio system when the ratio changing means changes the vibrator control ratio according to the loudness of the audio system.
Figure 5B:
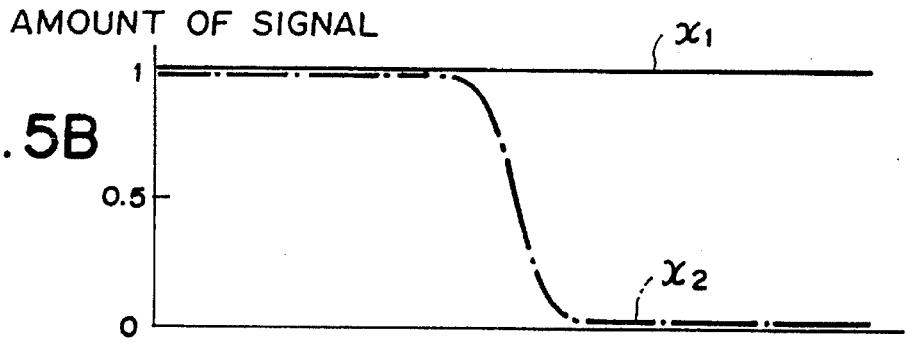

The case where the predetermined factor J is the loudness of the audio system on the vehicle, that is, the case where the ratio changing means 42 changes the vibrator control ratio according to the loudness of the audio system on the vehicle will be described, hereinbelow. FIGS. 5A and 5B respecively show the relation of the input frequencies of the detecting signals $e_1$ and $e_2$ to the loudness of the audio system and the relation of the amount of the adjusted reference signals $x_1$ and $x_2$ input into the drive control means 6 to the loudness of the audio system when the ratio changing means 42 changes the vibrator control ratio according to the loudness of the audio system.

As shown in FIGS. 5A and 5B, when the loudness of the audio system is higher than a predetermined level, the ratio changing means 42 increases the input frequency of the detecting signal $e_1$ from the acceleration sensor 32 and nullifies the input frequency of the detecting signal $e_2$ from the microphone 2, thereby allotting all the operational power of the drive control means 6 to the control of the vibrating engine mount 36.

In addition to change of the input frequencies of the detecting signals $e_1$ and $e_2$, the ratio changing means 42 causes the attenuators 40*a* and 40*b* to keep large the amount of the adjusted reference signal $x_1$ input into the adaptive filter $F_1$ irrespective of the loudness of the audio system and nullify the adjusted reference signal $x_2$ input into the adaptive filter $F_2$ when the loudness of the audio system becomes higher than the predetermined level.

When the loudness of the audio system exceeds the predetermined level, the microphone 2 detects the noise due to the vibration of the power unit together with the sound of the audio system, satisfactory vibration damping effect cannot be obtained even if the speaker 4 is driven. On the other hand, since the acceleration sensor 32 does not detect the sound of the audio system, the vibration of the vehicle body 1 can be satisfactorily damped by driving the vibrating engine mount 36.

For this reason, damping of the vibration of the vehicle body 1 is preferentially effected when the loudness of the audio system exceeds the predetermined level, whereby the vibration of the vehicle body 1 can be effectively damped without increasing the operational load on the drive control means 6 and consumption of electric power can be suppressed by not driving the speaker 4, driving of which will be almost useless when the loudness of the audio system is high.

Figure 6A:
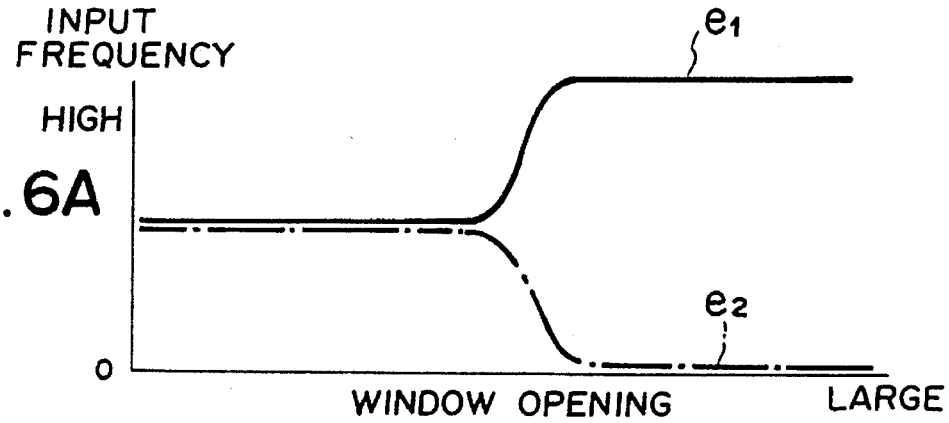
FIGS. 6A and 6B are views respectively showing the relation of the input frequencies of the detecting signals to the degree of opening of the window and the relation of the amount of the adjusted reference signals input into the drive control means to the degree of opening of the window when the ratio changing means changes the vibrator control ratio according to the degree of opening of the window.
Figure 6B:
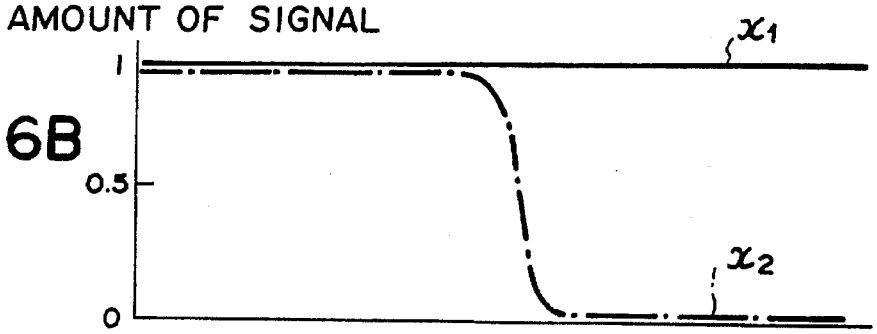

The case where the predetermined factor J is the degree of opening of the window, that is, the case where the ratio changing means 42 changes the vibrator control ratio according to the degree of opening of the window will be described, hereinbelow. FIGS. 6A and 6B respecively show the relation of the input frequencies of the detecting signals $e_1$ and $e_2$ to the degree of opening of the window and the relation of the amount of the adjusted reference signals $x_1$ and $x_2$ input into the drive control means 6 to the degree of opening of the window when the ratio changing means 42 changes the vibrator control ratio according to the degree of opening of the window.

As shown in FIGS. 6A and 6B, when the degree of opening of the window is higher than a predetermined value, the ratio changing means 42 increases the input frequency of the detecting signal $e_1$ from the acceleration sensor 32 and nullifies the input frequency of the detecting signal $e_2$ from the microphone 2, thereby allotting all the operational power of the drive control means 6 to the control of the vibrating engine mount 36.

In addition to change of the input frequencies of the detecting signals $e_1$ and $e_2$, the ratio changing means 42 causes the attenuators 40*a* and 40*b* to keep large the amount of the adjusted reference signal $x_1$ input into the adaptive filter $F_1$ irrespective of the degree of opening of the window and nullify the adjusted reference signal $x_2$ input into the adaptive filter $F_2$ when the degree of opening of the window becomes higher than the predetermined value.

When the degree of opening of the window exceeds the predetermined value, the microphone 2 detects the noise due to the vibration of the power unit together with the wind noise, satisfactory vibration damping effect cannot be obtained even if the speaker 4 is driven. On the other hand, since the acceleration sensor 32 does not detect the wind noise, the vibration of the vehicle body 1 can be satisfactorily damped by driving the vibrating engine mount 36.

For this reason, damping of the vibration of the vehicle body 1 is preferentially effected when the degree of opening of the window exceeds the predetermined value, whereby the vibration of the vehicle body 1 can be effectively damped without increasing the operational load on the drive control means 6 and consumption of electric power can be suppressed by not driving the speaker 4, driving of which will be almost useless when the window is opened wide.

Figure 7A:
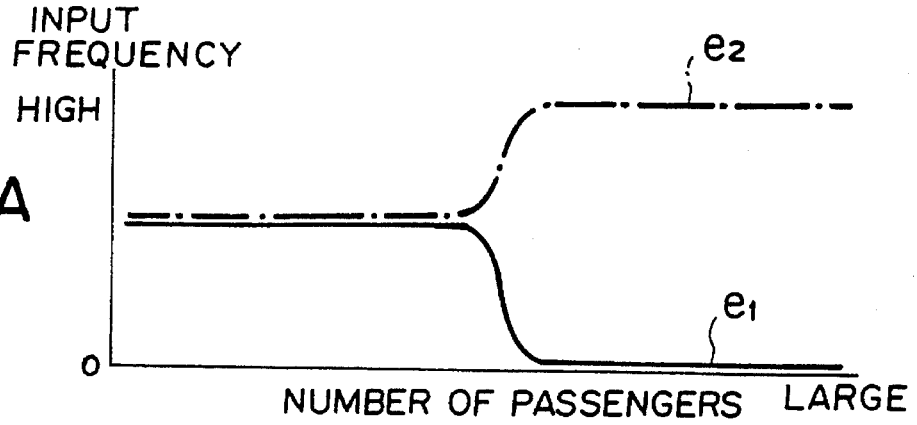
FIGS. 7A and 7B are views respectively showing the relation of the input frequencies of the detecting signals to the number of the passengers and the relation of the amount of the adjusted reference signals input into the drive control means to the number of the passengers when the ratio changing means changes the vibrator control ratio according to the number of the passengers.
Figure 7B:
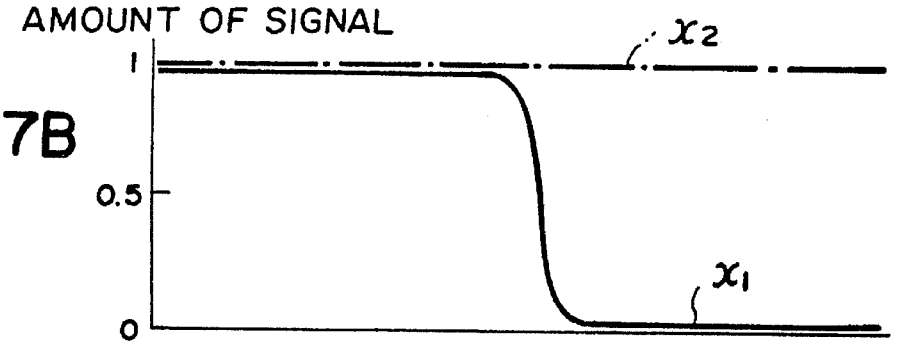

The case where the predetermined factor J is the number of the passengers, that is, the case where the ratio changing means 42 changes the vibrator control ratio according to the number of the passengers will be described, hereinbelow. FIGS. 7A and 7B respecively show the relation of the input frequencies of the detecting signals $e_1$ and $e_2$ to the number of the passengers and the relation of the amount of the adjusted reference signals $x_1$ and $x_2$ input into the drive control means 6 to the number of the passengers when the ratio changing means 42 changes the vibrator control ratio according to the number of the passengers.

As shown in FIGS. 7A and 7B, when the number of the passengers is larger than a predetermined value, the ratio changing means 42 nullifies the input frequency of the detecting signal $e_1$ from the acceleration sensor 32 and increases the input frequency of the detecting signal $e_2$ from the microphone 2, thereby allotting all the operational power of the drive control means 6 to the control of the speaker 4.

In addition to change of the input frequencies of the detecting signals $e_1$ and $e_2$, the ratio changing means 42 causes the attenuators 40*a* and 40*b* to keep large the amount of the adjusted reference signal $x_2$ input into the adaptive filter $F_2$ irrespective of the number of the passengers and nullify the adjusted reference signal $x_1$ input into the adaptive filter $F_1$ when the number of the passengers is larger than the predetermined value.

When the number of the passengers is large, the total weight of the vehicle increases and the level of the vibration of the vehicle body 1 due to the vibration of the engine E does not so increase even if the vibration of the engine E increases to a high level. On the other hand, the noise in the cabin caused due to the vibration of the engine E more disturbs passenger's conversation as the number of the passengers increases.

For this reason, damping of the noise in the cabin is preferentially effected when the number of the passengers exceeds the predetermined value, whereby the noise in the cabin can be effectively damped without increasing the operational load on the drive control means 6 and consumption of electric power can be suppressed by not driving the vibrating engine mount 36, driving of which will be almost useless when the number of the passengers is large.

Figure 8A:
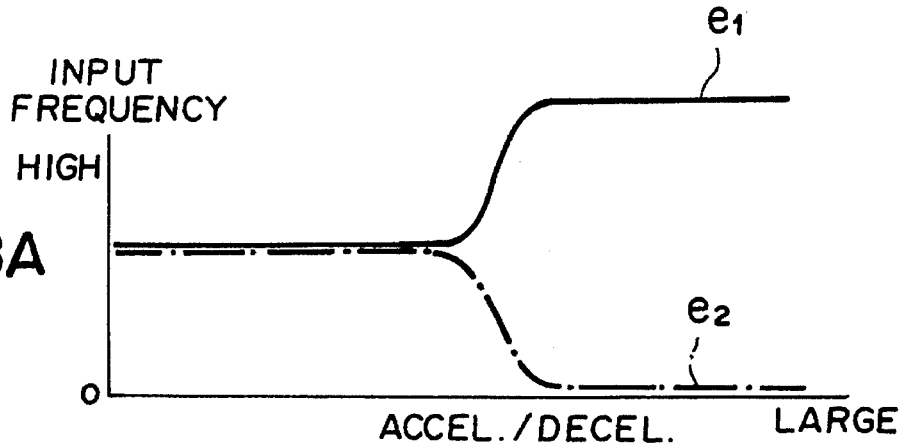
FIGS. 8A and 8B are views respectively showing the relation of the input frequencies of the detecting signals to the degree of acceleration and deceleration of the vehicle and the relation of the amount of the adjusted reference signals input into the drive control means to the degree of acceleration and deceleration of the vehicle when the ratio changing means changes the vibrator control ratio according to the degree of acceleration and deceleration of the vehicle.
Figure 8B:
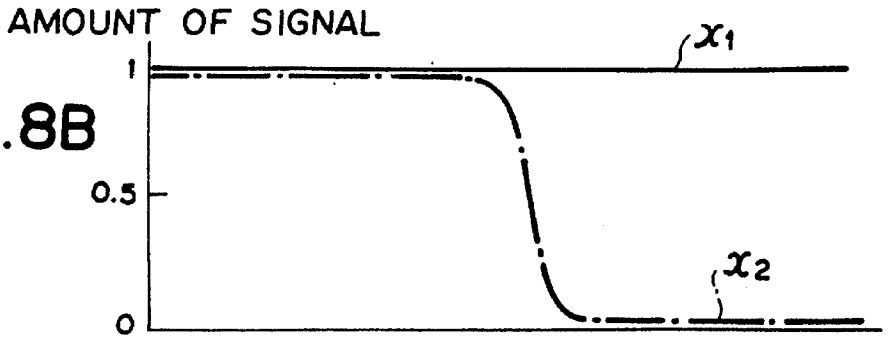

The case where the predetermined factor J is the degree of acceleration and deceleration of the vehicle, that is, the case where the ratio changing means 42 changes the vibrator control ratio according to the degree of acceleration and deceleration of the vehicle will be described, hereinbelow. FIGS. 8A and 8B respecively show the relation of the input frequencies of the detecting signals $e_1$ and $e_2$ to the degree of acceleration and deceleration of the vehicle and the relation of the amount of the adjusted reference signals $x_1$ and $x_2$ input into the drive control means 6 to the degree of acceleration and deceleration of the vehicle when the ratio changing means 42 changes the vibrator control ratio according to the degree of acceleration and deceleration of the vehicle.

As shown in FIGS. 8A and 8B, when the degree of acceleration and deceleration of the vehicle is higher than a predetermined value, the ratio changing means 42 increases the input frequency of the detecting signal $e_1$ from the acceleration sensor 32 and nullifies the input frequency of the detecting signal $e_2$ from the microphone 2, thereby allotting all the operational power of the drive control means 6 to the control of the vibrating engine mount 36.

In addition to change of the input frequencies of the detecting signals $e_1$ and $e_2$, the ratio changing means 42 causes the attenuators 40*a* and 40*b* to keep large the amount of the adjusted reference signal $x_1$ input into the adaptive filter $F_1$ irrespective of the degree of acceleration and deceleration of the vehicle and nullify the adjusted reference signal $x_2$ input into the adaptive filter $F_2$ when the degree of acceleration and deceleration of the vehicle becomes higher than the predetermined value.

When the degree of acceleration and deceleration of the vehicle exceeds the predetermined value, the level of the engine vibration increases to increase the vibration of the vehicle body 1 and the noise in the cabin. During acceleration or deceleration of the vehicle, vibration of the vehicle body 1 generally bothers the passengers but the noise in the cabin generally does not bother the passengers. For example, sound of the engine during acceleration sometimes sounds comfortable for the passengers.

For this reason, damping of the vibration of the vehicle body 1 is preferentially effected when the degree of acceleration and deceleration of the vehicle exceeds the predetermined value, whereby the vibration of the vehicle body 1 can be effectively damped without increasing the operational load on the drive control means 6 and consumption of electric power can be suppressed by not driving the speaker 4, driving of which will be almost useless when the degree of acceleration and deceleration of the vehicle is large.

Figure 9A:
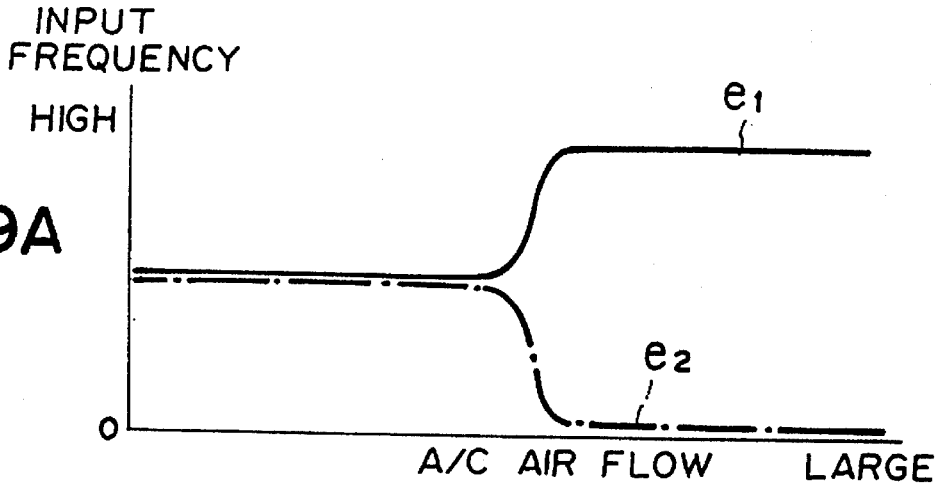
FIGS. 9A and 9B are views respectively showing the relation of the input frequencies of the detecting signals to the air flow of the air-conditioner and the relation of the amount of the adjusted reference signals input into the drive control means to the air flow of the air-conditioner when the ratio changing means changes the vibrator control ratio according to the air flow of the air-conditioner.
Figure 9B:
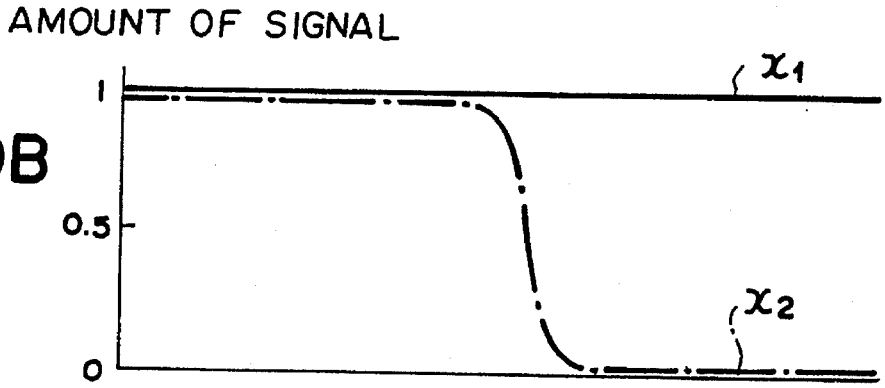

The case where the predetermined factor J is the air flow of the air-conditioner, that is, the case where the ratio changing means 42 changes the vibrator control ratio according to the air flow of the air-conditioner will be described, hereinbelow. FIGS. 9A and 9B respecively show the relation of the input frequencies of the detecting signals $e_1$ and $e_2$ to the air flow of the air-conditioner and the relation of the amount of the adjusted reference signals $x_1$ and $x_2$ input into the drive control means 6 to the air flow of the air-conditioner when the ratio changing means 42 changes the vibrator control ratio according to the air flow of the air-conditioner.

As shown in FIGS. 9A and 9B, when the air flow of the air-conditioner is larger than a predetermined value, the ratio changing means 42 increases the input frequency of the detecting signal $e_1$ from the acceleration sensor 32 and nullifies the input frequency of the detecting signal $e_2$ from the microphone 2, thereby allotting all the operational power of the drive control means 6 to the control of the vibrating engine mount 36.

In addition to change of the input frequencies of the detecting signals $e_1$ and $e_2$, the ratio changing means 42 causes the attenuators 40*a* and 40*b* to keep large the amount of the adjusted reference signal $x_1$ input into the adaptive filter $F_1$ irrespective of the air flow of the air-conditioner and nullify the adjusted reference signal $x_2$ input into the adaptive filter $F_2$ when the air flow of the air-conditioner becomes larger than the predetermined value.

When the air flow of the air-conditioner exceeds the predetermined value, the microphone 2 detects the noise due to the vibration of the power unit together with the noise of the air-conditioner, satisfactory vibration damping effect cannot be obtained even if the speaker 4 is driven. On the other hand, since the acceleration sensor 32 does not detect the noise of the air-conditioner, the vibration of the vehicle body 1 can be satisfactorily damped by driving the vibrating engine mount 36.

For this reason, damping of the vibration of the vehicle body 1 is preferentially effected when the air flow of the air-conditioner exceeds the predetermined value, whereby the vibration of the vehicle body 1 can be effectively damped without increasing the operational load on the drive control means 6 and consumption of electric power can be suppressed by not driving the speaker 4, driving of which will be almost useless when the air flow of the air-conditioner is large.

Figure 10:
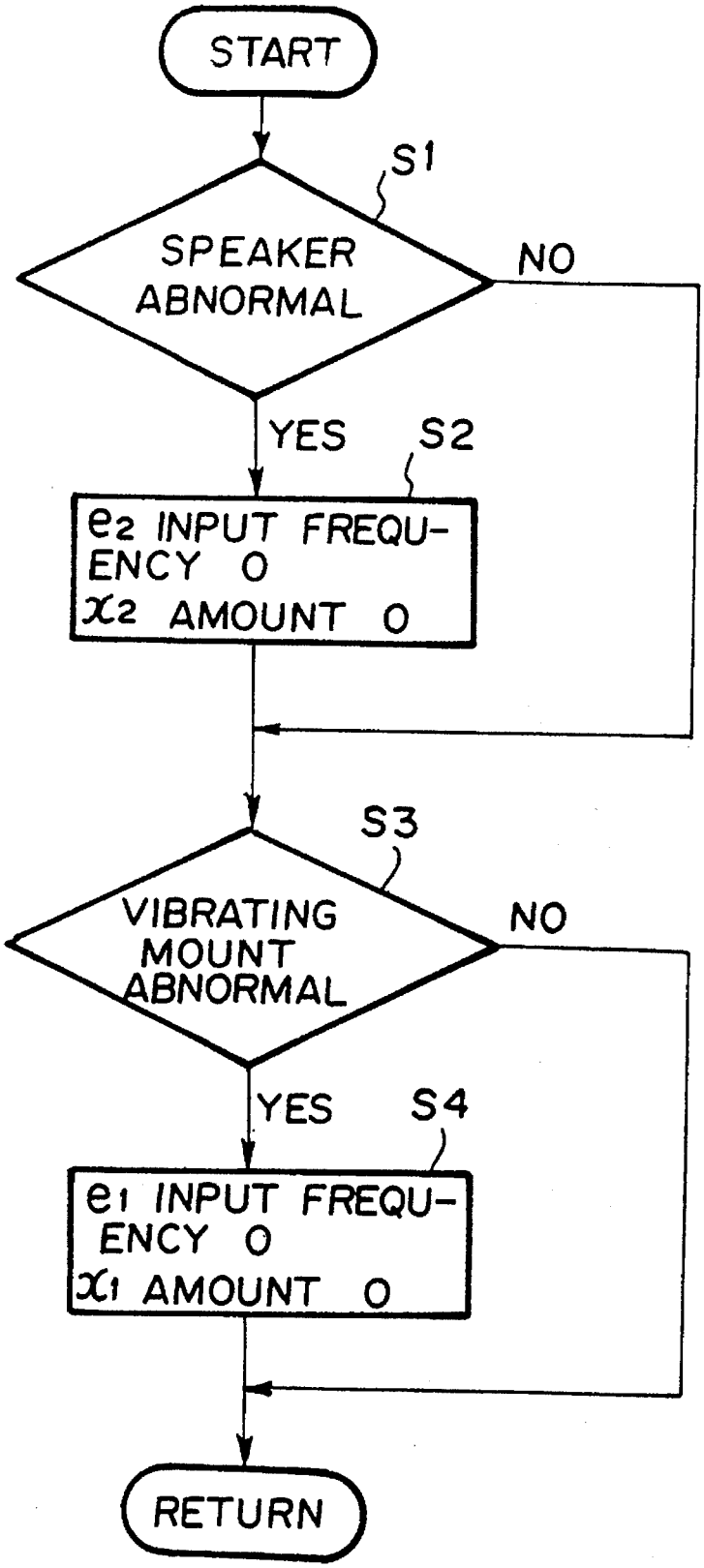
FIG. 10 is a flow chart for illustrating the operation of the ratio changing means 42 when changing the vibrator control ratio according to whether the vibrating engine mount and the speaker are in the normal condition.

The case where the predetermined factor J is whether the vibrators are in the normal condition or in an abnormal condition, that is, the case where the ratio changing means 42 changes the vibrator control ratio according to whether the vibrating engine mount 36 and the speaker 4 are in the normal condition will be described, hereinbelow. FIG. 10 is a flow chart for illustrating the operation of the ratio changing means 42 in changing the vibrator control ratio in this case.

In FIG. 10, the ratio changing means 42 first determines whether the speaker 4 is in an abnormal condition. (step S1) When it is determined that the speaker 4 is in an abnormal condition, the ratio changing means 42 nullifies the input frequency of the detecting signal $e_2$ from the microphone 2 and the adjusted reference signal $x_2$ input into the adaptive filter $F_2$. (step S2) After step S2 or when it is determined that the speaker 4 is not in an abnormal condition, the ratio changing means 42 determines whether the vibrating engine mount 36 is in an abnormal condition. (step S3) When it is determined that the vibrating engine mount 36 is in an abnormal condition, the ratio changing means 42 nullifies the input frequency of the detecting signal $e_1$ from the acceleration sensor 32 and the adjusted reference signal $x_1$ input into the adaptive filter $F_1$. (step S4) After step S4 or when it is determined that the vibrating engine mount 36 is not in an abnormal condition, the ratio changing means 42 returns.

When the speaker 4 is in an abnormal condition, driving the speaker 4 to damp the noise in the cabin cannot result in expected noise damping effect but may result in increase in noise. Similarly when the vibrating engine mount 36 is in an abnormal condition, driving the vibrating engine mount 36 to damp the vibration of the vehicle body 1 cannot result in expected vibration damping effect but may result in increase in vibration of the vehicle body 1.

Thus in this example, the abnormal vibrator(s) is not driven and accordingly, vibration of air and/or solid elements can be prevented from being increased by driving abnormal vibrator(s). Further consumption of electric power can be suppressed by not driving abnormal vibrator(s). Further since when one of the speaker 4 and the vibrating engine mount 36 is in the abnormal state, all the operational power of the drive control means 6 is allotted to the control of the other, one of the noise in the cabin and the vibration of the vehicle body 1 can be effectively damped.

When only the vibrating engine mount 36 is in an abnormal condition, the ratio changing means 42 may maximize the input frequency of the detecting signal $e_2$ from the speaker 4 in addition to nullifying the input frequency of the detecting signal $e_1$ from the acceleration sensor 32 and the adjusted reference signal $x_1$ input into the adaptive filter $F_1$. When only the speaker 4 is in an abnormal condition, the ratio changing means 42 may maximize the input frequency of the detecting signal $e_1$ from the acceleration sensor 32 in addition to nullifying the input frequency of the detecting signal $e_2$ from the speaker 4 and the adjusted reference signal $x_2$ input into the adaptive filter $F_2$.

Figure 11:
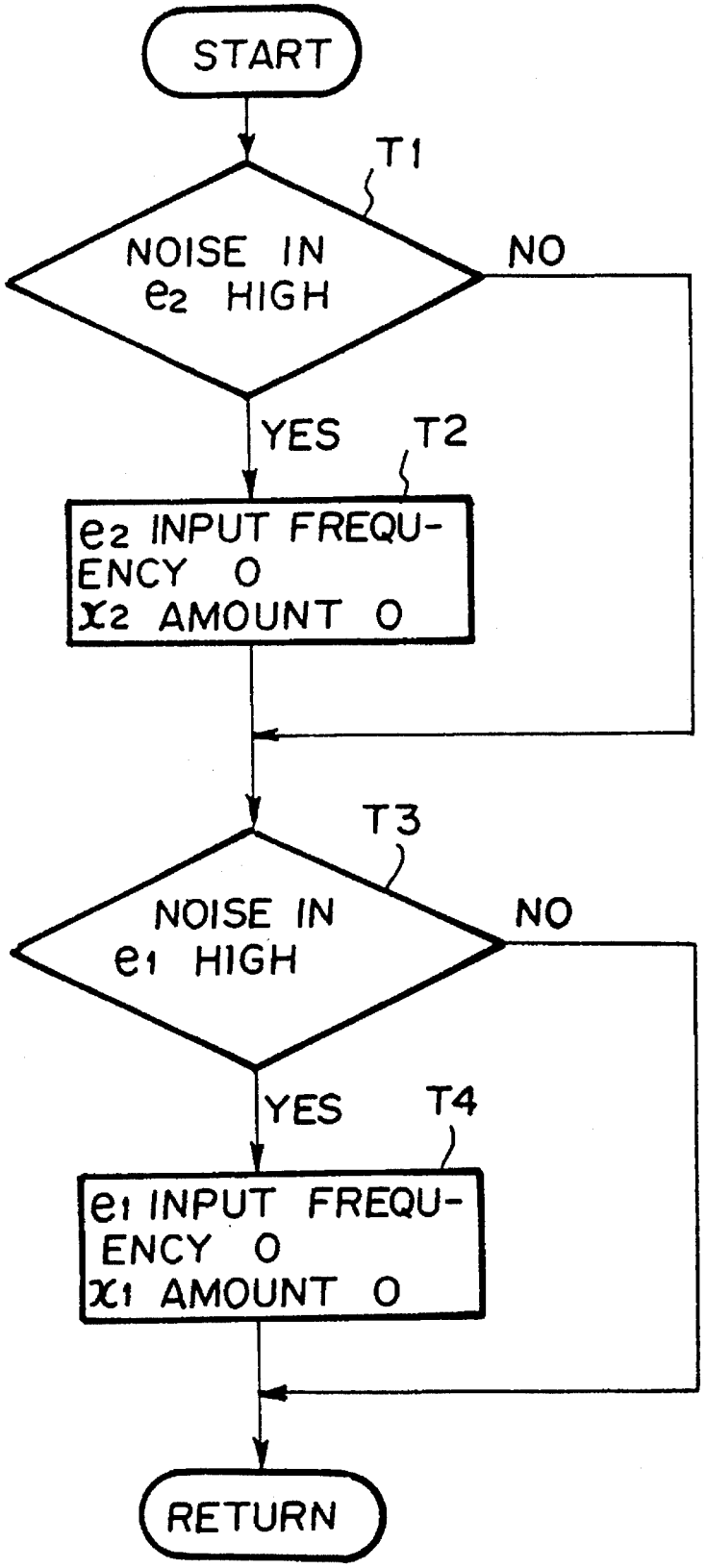
FIG. 11 is a flow chart for illustrating the operation of the ratio changing means when changing the vibrator control ratio according to the noise level in the detecting signals.

The case where the predetermined factor J is the noise level in the detecting signals $e_1$ and $e_2$, that is, the case where the ratio changing means 42 changes the vibrator control ratio according to the noise level in the detecting signals $e_1$ and $e_2$ will be described, hereinbelow. FIG. 11 is a flow chart for illustrating the operation of the ratio changing means 42 in changing the vibrator control ratio in this case.

In FIG. 11, the ratio changing means 42 first determines whether the noise level in the detecting signal $e_2$ is higher than a predetermined level. (step T1) When it is determined that the noise level in the detecting signal $e_2$ is higher than the predetermined level, the ratio changing means 42 nullifies the input frequency of the detecting signal $e_2$ from the microphone 2 and the adjusted reference signal $x_2$ input into the adaptive filter $F_2$. (step T2) After step T2 or when it is determined that the noise level in the detecting signal $e_2$ is not higher than the predetermined level, the ratio changing means 42 determines whether the noise level in the detecting signal $e_1$ is higher than a predetermined level. (step T3) When it is determined that the noise level in the detecting signal $e_1$ is higher than the predetermined level, the ratio changing means 42 nullifies the input frequency of the detecting signal $e_1$ from the acceleration sensor 32 and the adjusted reference signal $x_1$ input into the adaptive filter $F_1$. (step T4) After step T4 or when it is determined that the noise level in the detecting signal $e_1$ is not higher than the predetermined level, the ratio changing means 42 returns.

When the noise level in the detecting signal $e_2$ from the microphone 2 is high, driving the speaker 4 to damp the noise in the cabin cannot result in expected noise damping effect but may result in increase in noise. Similarly when the noise level in the detecting signal $e_1$ from the acceleration sensor 32 is high, driving the vibrating engine mount 36 to damp the vibration of the vehicle body 1 cannot result in expected vibration damping effect but may result in increase in vibration of the vehicle body 1.

Thus in this example, the detecting signal whose noise level is high is not input and accordingly, vibration of air and/or solid elements can be prevented from being increased by driving the vibrating engine mount 36 and/or speaker 4 on the basis of detecting signal including a large amount of noise. Further consumption of electric power can be suppressed by not driving the vibrator(s) which is controlled on the basis of detecting signal including a large amount of noise. Further since when one of the detecting signals $e_1$ and $e_2$ includes a large amount of noise, all the operational power of the drive control means 6 is allotted to the control of the vibrator which is controlled on the basis of the other detecting signals, one of the noise in the cabin and the vibration of the vehicle body 1 can be effectively damped.

When only the detecting signal $e_1$ from the acceleration sensor 32 includes a large amount of noise, the ratio changing means 42 may maximize the input frequency of the detecting signal $e_2$ from the speaker 4 in addition to nullifying the input frequency of the detecting signal $e_1$ from the acceleration sensor 32 and the adjusted reference signal $x_1$ input into the adaptive filter $F_1$. When only the detecting signal $e_2$ from the speaker 4 includes a large amount of noise, the ratio changing means 42 may maximize the input frequency of the detecting signal $e_1$ from the acceleration sensor 32 in addition to nullifying the input frequency of the detecting signal $e_2$ from the speaker 4 and the adjusted reference signal $x_2$ input into the adaptive filter $F_2$.

Figure 12:
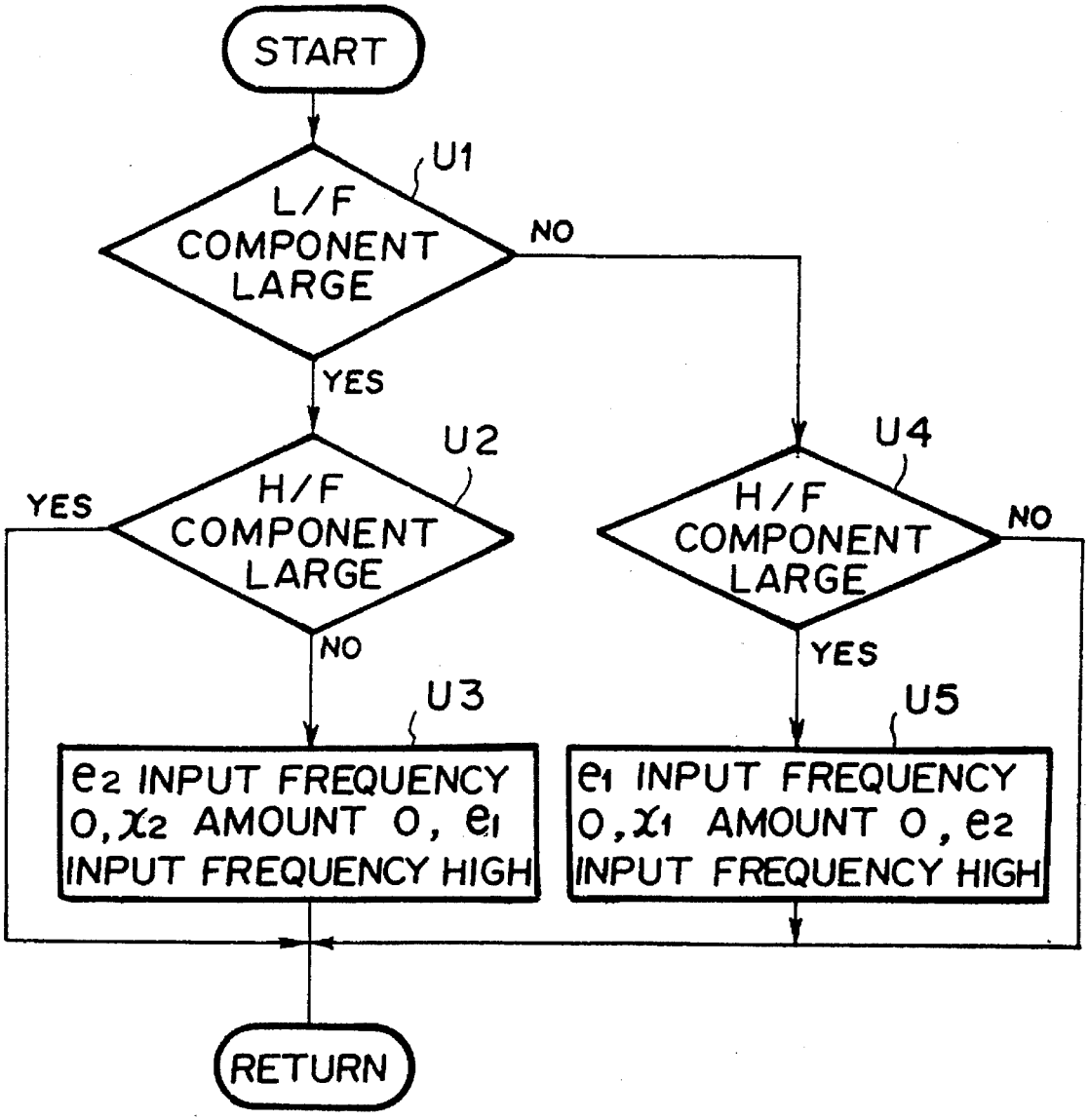
FIG. 12 is a flow chart for illustrating the operation of the ratio changing means when changing the vibrator control ratio according to the vibration of the engine.

The case where the predetermined factor J is the vibration of the engine E, that is, the case where the ratio changing means 42 changes the vibrator control ratio according to the vibration of the engine E will be described, hereinbelow. FIG. 12 is a flow chart for illustrating the operation of the ratio changing means 42 in changing the vibrator control ratio in this case.

In FIG. 12, the ratio changing means 42 first determines whether the amplitude of the low frequency component of the vibration of the engine E is larger than a predetermined value. (step U1) When it is determined that the amplitude of the low frequency component of the vibration of the engine E is larger than the predetermined value, the ratio changing means 42 determines whether the amplitude of the high frequency component of the vibration of the engine E is larger than a predetermined value. (step U2) When it is determined in step U2 that the amplitude of the high frequency component of the vibration of the engine E is not larger than the predetermined value, the ratio changing means 42 nullifies the input frequency of the detecting signal $e_2$ from the microphone 2 and the adjusted reference signal $x_2$ input into the adaptive filter $F_2$ and at the same time increases the input frequency of the detecting signal $e_1$ from the acceleration sensor 32. (step U3) When it is determined in step U1 that the amplitude of the low frequency component of the vibration of the engine E is not larger than the predetermined value, the ratio changing means 42 determines whether the amplitude of the high frequency component of the vibration of the engine E is larger than a predetermined value. (step U4) When it is determined in step U4 that the amplitude of the high frequency component of the vibration of the engine E is larger than the predetermined value, the ratio changing means 42 nullifies the input frequency of the detecting signal $e_1$ from the acceleration sensor 32 and the adjusted reference signal $x_1$ input into the adaptive filter $F_1$ and at the same time increases the input frequency of the detecting signal $e_2$ from the microphone 2. (step U5) When it is determined in step U2 that the amplitude of the high frequency component of the vibration of the engine E is larger than the predetermined value or when it is determined in step U4 that the amplitude of the high frequency component of the vibration of the engine E is not larger than the predetermined value, the ratio changing means 42 returns without changing the input frequencies of the detecting signals $e_1$ and $e_2$ and the amounts of the adjusted reference signals $x_1$ and The vibration of the vehicle body 1 due to the vibration of the engine E increases when the amplitude of the low frequency component of the vibration of the engine E is large, and the noise in the cabin due to the vibration of the engine E increases when the amplitude of the high frequency component of the vibration of the engine E is large.

In this example, when the amplitude of the low frequency component is large and the amplitude of the high frequency component is small, damping of the vibration of the vehicle body 1 is preferentially effected and damping of the noise in the cabin is not effected. With this arrangement, in the case the amplitude of the low frequency component large with the amplitude of the high frequency component being small where the vibration of the vehicle body 1 bothers the passengers more than the noise in the cabin, the vibration of the vehicle body 1 can be effectively damped well following the fluctuation thereof. Further since the input frequency of the detecting signal $e_2$ is nullified though the input frequency of the detecting signal $e_1$ is increased, the operational load on the drive control means 6 is not increased. Further since the speaker 4 driving of which will be almost useless in this case is not driven, consumption of electric power can be suppressed.

On the other hand, when the amplitude of the high frequency component is large and the amplitude of the low frequency component is small, damping of the noise in the cabin is preferentially effected and damping of the vibration of the vehicle body 1 is not effected. With this arrangement, in the case the amplitude of the high frequency component large with the amplitude of the low frequency component being small where the noise in the cabin bothers the passengers more than the vibration of the vehicle body 1, the noise in the cabin can be effectively damped well following the fluctuation thereof without increasing the operational load on the drive control means 6. Further since the vibrating engine mount 36 driving of which will be almost useless in this case is not driven, consumption of electric power can be suppressed.

Though, in the examples described above, the ratio changing means 42 automatically changes the vibrator control ratio according to the condition of the various factors J, the vibration damping system of the first embodiment may be modified so that the vibrator control ratio can be manually changed. An example of such a modification will be described, hereinbelow.

Figure 13:
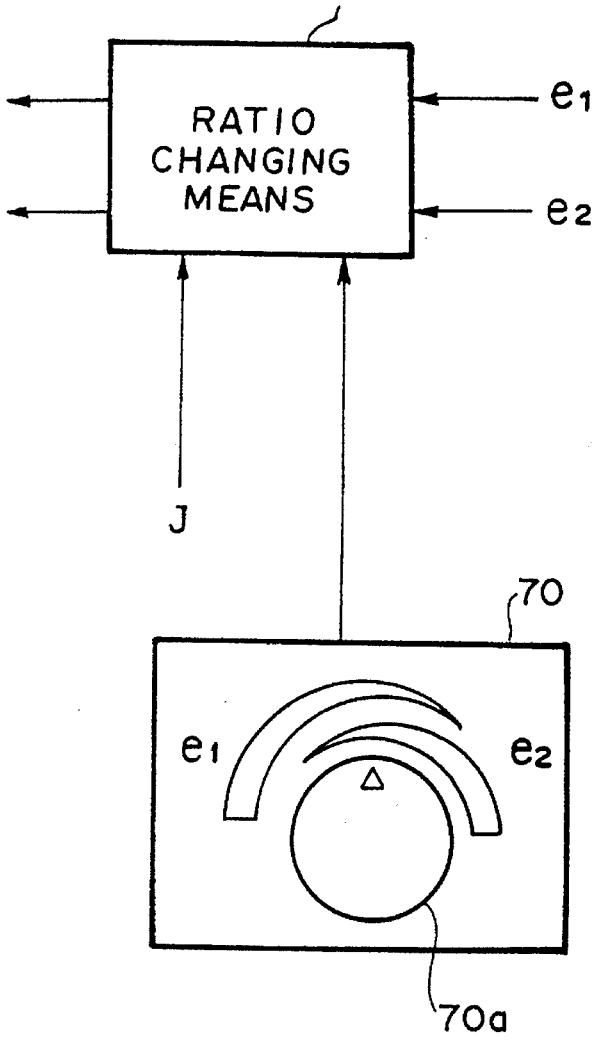
FIG. 13 is a schematic view showing a manual ratio setting means.
Figure 14:
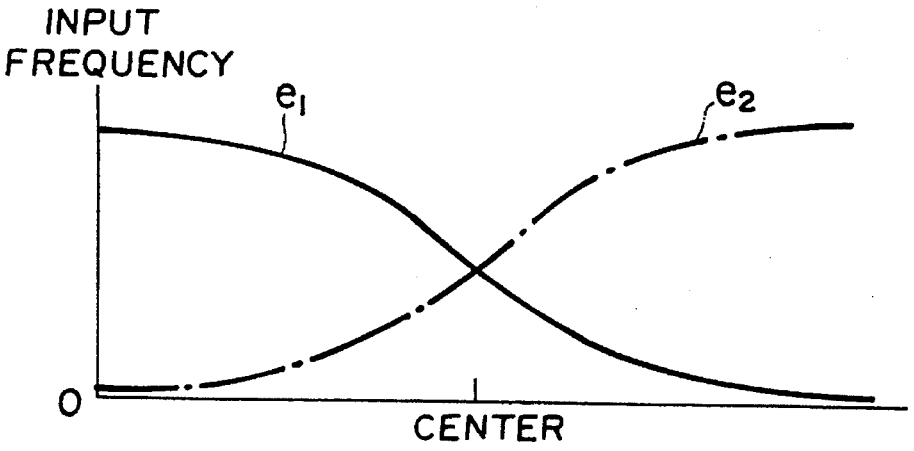
FIG. 14 is a view showing the change of the input frequencies of the detecting signals when the vibrator control ratio is manually changed.

In this modification, a manual ratio setting means 70 shown in FIG. 13 is provided. By operating the manual ratio setting means 70, the passenger can set the input frequencies of the detecting signals $e_1$ and $e_2$ in preference to the ratio changing means 42. The manual ratio setting means 70 is disposed in a position where the passenger can operate it inside the cabin, e.g., on an instrument panel, and has a control dial 70*a* for manually setting the input frequencies. That is, as the control dial 70*a* is rotated leftward, the input frequency of the detecting signal $e_1$ is increased and the input frequency of the detecting signal $e_2$ is reduced while when the control dial 70*a* is rotated rightward, the input frequency of the detecting signal $e_1$ is reduced and the input frequency of the detecting signal $e_2$ is increased as shown in FIG. 14, whereby the vibrator control ratio can be manually changed according to the passenger's will.

Thus, by providing the manual ratio setting means 70, one of the vibration of the vehicle body 1 and the noise in the cabin which the passenger feels more bother some can be damped in preference to the other.

Figure 15:
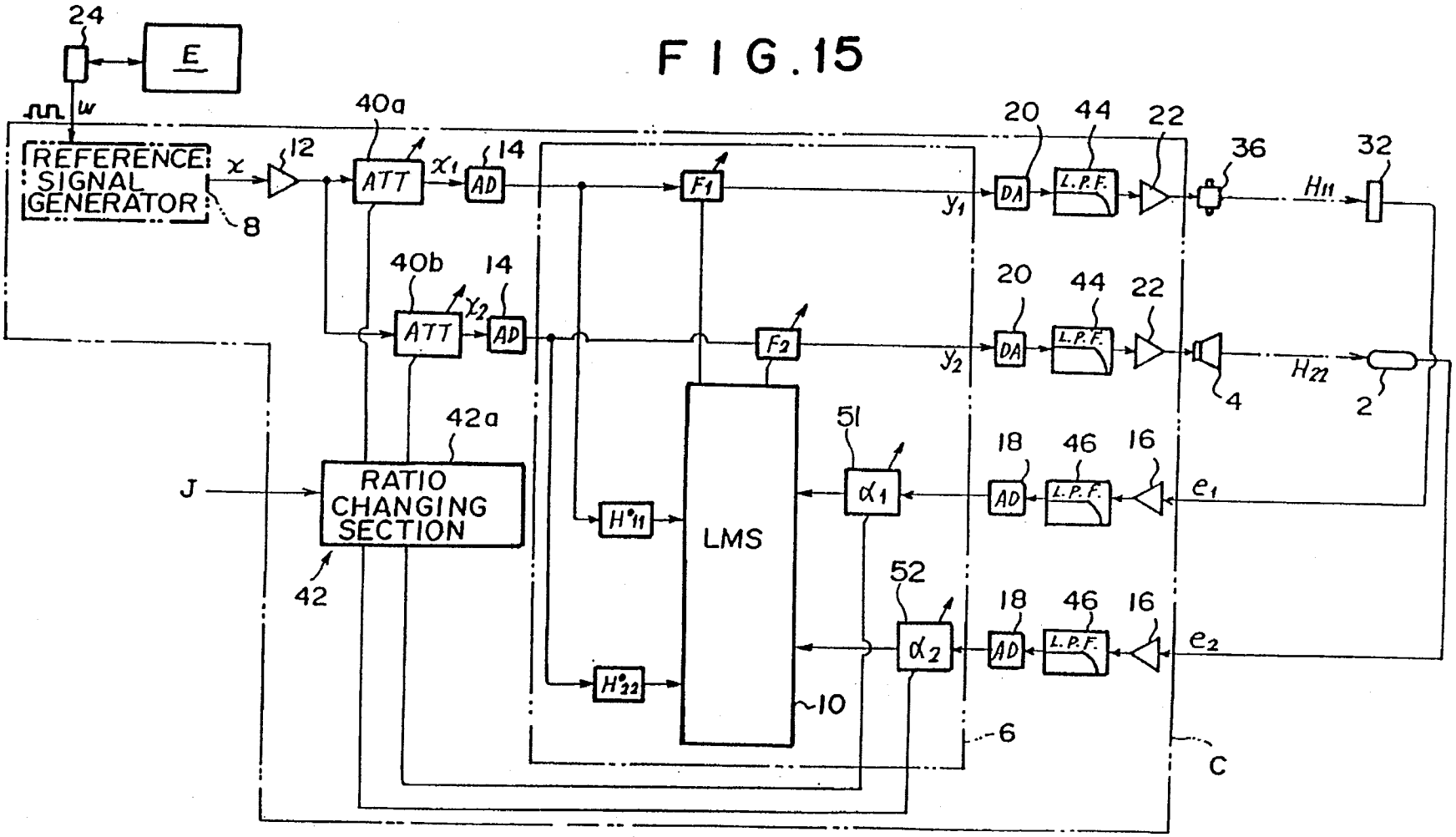
FIG. 15 is a schematic view showing the structure of the controller employed in the vibration damping system in accordance with a second embodiment of the present invention.

FIG. 15 is a schematic view showing the structure of the controller employed in the vibration damping system in accordance with a second embodiment of the present invention. The vibration damping system of this embodiment is basically the same as the first embodiment, and accordingly the parts analogous to those in the first embodiment will be given the same reference numerals and will not be described in detail here.

As shown in FIG. 15, the controller C comprises a reference signal generating means 8 which generates a reference signal x on the basis of an ignition pulse signal w generated by an ignition coil 24, a drive control means 6 which generates drive signals $y_1$ and $y_2$ for driving the vibrating engine mount 36 and the speaker 4. The drive control means 6 comprises adaptive filters $F_1$ and $F_2$ and an adaptive algorithm section 10 which adjusts the adaptive filters $F_1$ and $F_2$ so that the detecting signals $e_1$ to $e_2$ respectively input from the acceleration sensor 32 and the microphones 2 are minimized. In this embodiment, Least Mean Square Method is employed as the adaptive algorithm for adjusting the adaptive filters $F_1$ and $F_2$ and for this purpose, the drive control means 6 is provided with digital filters $H^{\circ}_{LM}$ (L standing for 1, 2 and M standing for 1, 2) which are modeled on the transmission properties between the vibrating engine mount 36 and the acceleration sensor 32 and between the speaker 4 and the microphone 2. Further the controller C has a ratio changing means 42 comprising a first convergent factor changing device 51 which changes a convergent factor $\alpha_1$ for the detecting signal $e_1$ from the acceleration sensor 32, a second convergent factor changing device 52 which changes a convergent factor $\alpha_2$ for the detecting signal $e_2$ from the microphone 2, attenuators 40*a* and 40*b* which attenuates the reference signal x input from the reference signal generating means by a predetermined amount, and a ratio changing section 42*a* which changes the attenuation rate of the reference signal x by the attenuators 40*a* and 40*b* according to the condition of a predetermined factor J of the vehicle.

In this embodiment, the ratio changing means 42 changes the vibrator control ratio by changing the amounts of the adjusted reference signals $x_1$ and $x_2$ which are input into the drive control means 6 after passing through the attenuators 40*a* and 40*b* and the convergent factors $\alpha_1$ and $\alpha_2$ according to the condition of the predetermined factor J of the vehicle, thereby changing the ratio of the proportion of the output amount of the drive signal $y_1$ to the optimal amount of the same to the proportion of the output amount of the drive signal $y_2$ to the optimal amount of the same. The term "the optimal amount of the drive signal $y_1$" means the amount of the drive signal $y_1$ which causes the vibrating engine mount 36 to vibrate by an amount optimal to damp the vibration of the vehicle body 1 and which is output when the amount of the adjusted reference signal $x_1$ is of a standard value and at the same time the convergent factor $\alpha_1$ is of a standard value. Similarly, the term "the optimal amount of the drive signal $y_2$" means the amount of the drive signal $y_2$ which causes the speaker 4 to vibrate by an amount optimal to damp the noise in the cabin and which is output when the amount of the adjusted reference signal $x_2$ is of a standard value and at the same time the convergent factor $\alpha_2$ is of a standard value. Change of the vibrator control ratio by the ratio changing means 42 for various factors will be described, hereinbelow.

Figure 16A:
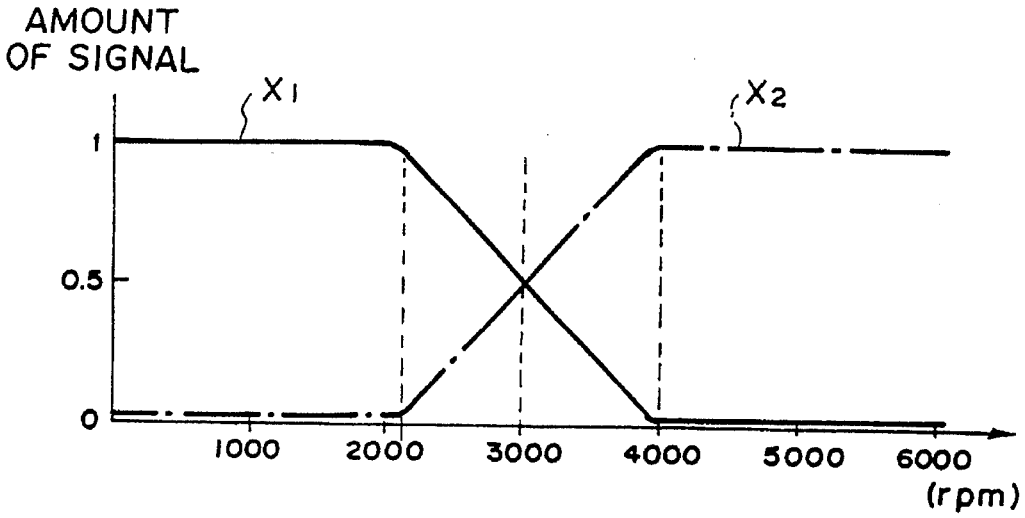
FIGS. 16A to 16C are views respectively showing the relation of the amounts of the reference signals to the engine speed, the relation of the values of the convergent factors to the engine speed when the engine speed increases from a low speed range to a high speed range, and the relation of the values of the convergent factors to the engine speed when the engine speed decreases from the high speed range to the low speed range in the case where the ratio changing means shown in FIG. 15 changes the vibrator control ratio according to the engine speed, the broken lines in the drawings showing the correspondence therebteween.
Figure 16B:
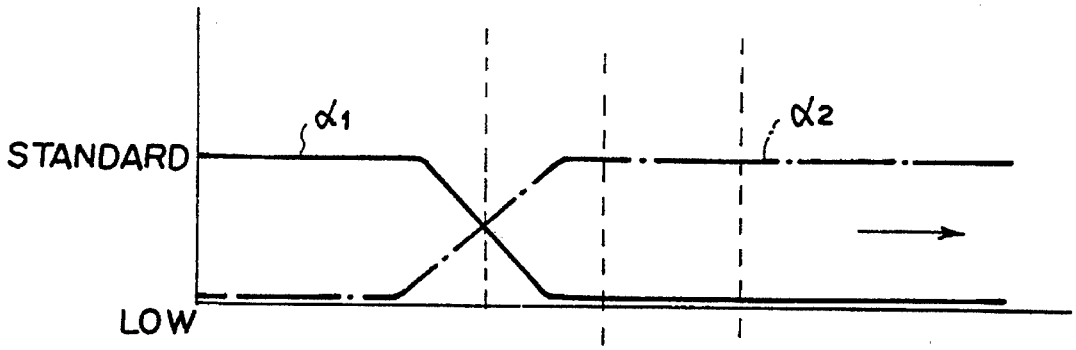
Figure 16C:
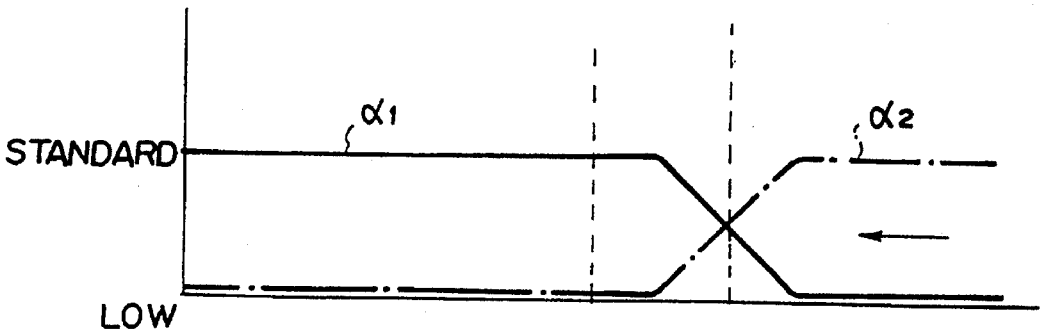
Figure 17A:
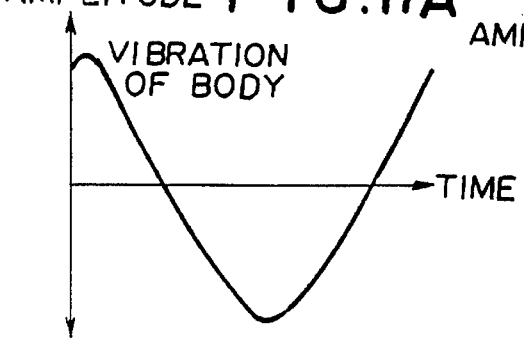
FIGS. 17A to 17H show damping of the vibration of the vehicle body and the noise in the cabin at 1000 rpm when the vibrator control ratio is changed in the manner shown in FIG. 16, FIGS. 18A to 18H show damping of the vibration of the vehicle body and the noise in the cabin at 2500 rpm when the vibrator control ratio is changed in the manner shown in FIG. 16, FIGS. 19A to 19H show damping of the vibration of the vehicle body and the noise in the cabin at 4000 rpm when the vibrator control ratio is changed in the manner shown in FIG. 16, FIGS. 20A and 20B are views respectively showing the relation of the amounts of the reference signals to the vehicle speed and the relation of the convergent factors to the vehicle speed when the ratio changing means shown in FIG. 15 changes the vibrator control ratio according to the vehicle speed, the broken lines in the drawings showing the correspondence therebteween.
Figure 17B:
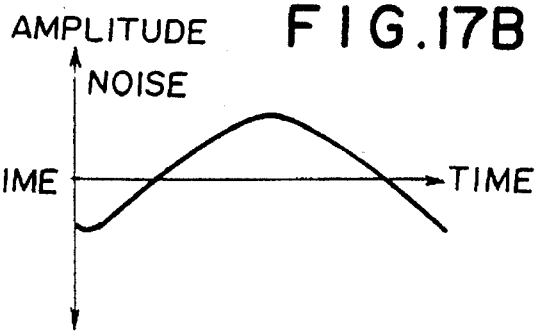
Figure 17C:
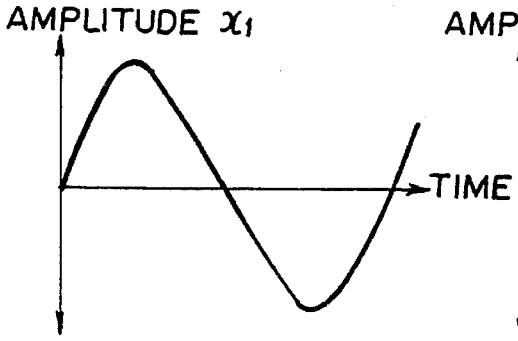
Figure 17D:
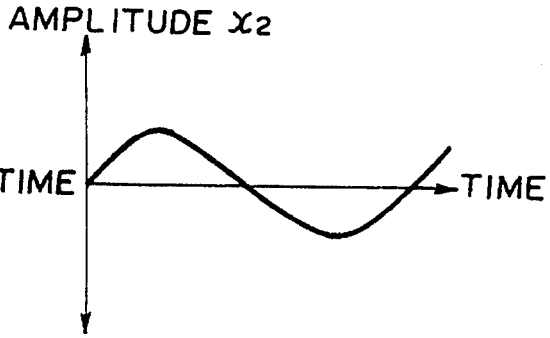
Figure 17E:
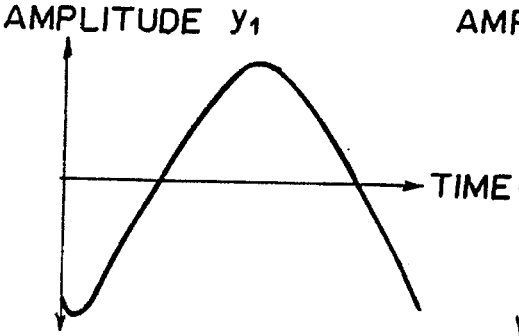
Figure 17F:
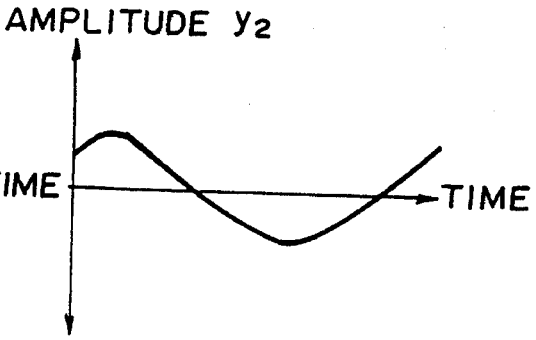
Figure 17G:
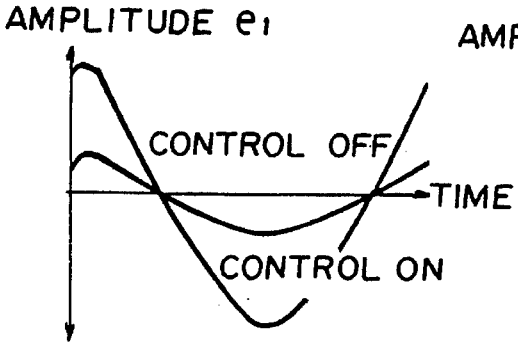
Figure 17H:
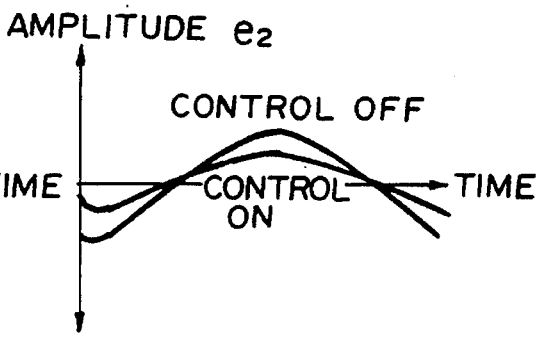
Figure 18A:
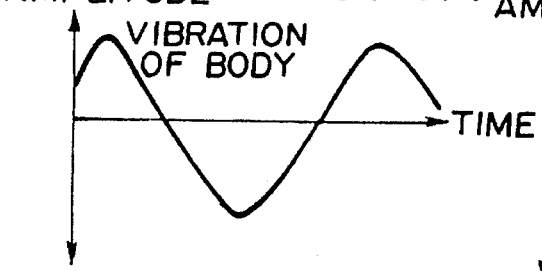
Figure 18B:
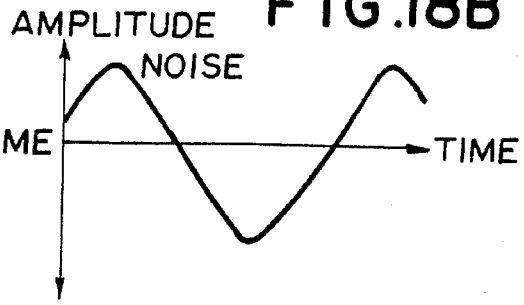
Figure 18C:
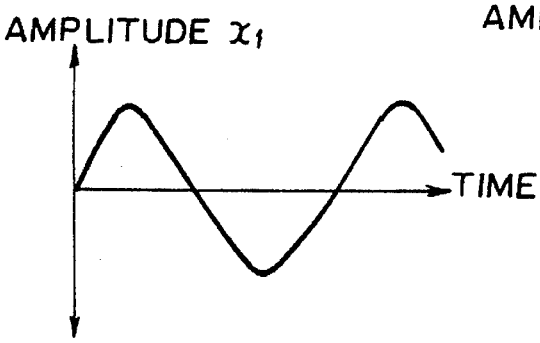
Figure 18D:
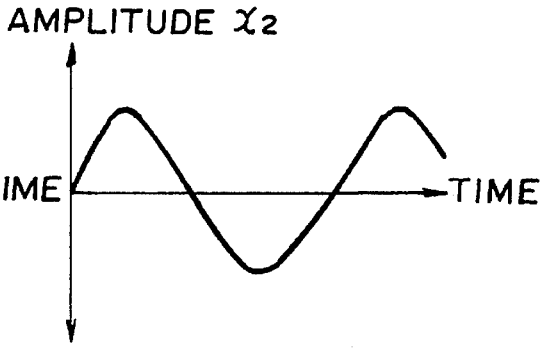
Figure 18E:
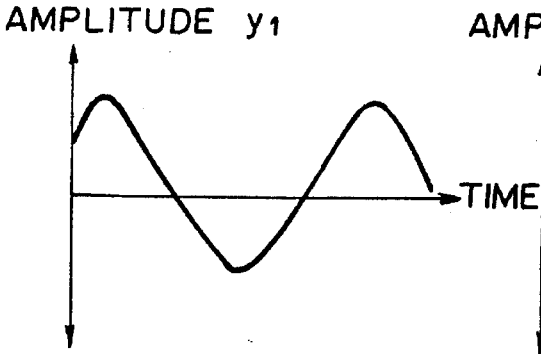
Figure 18F:
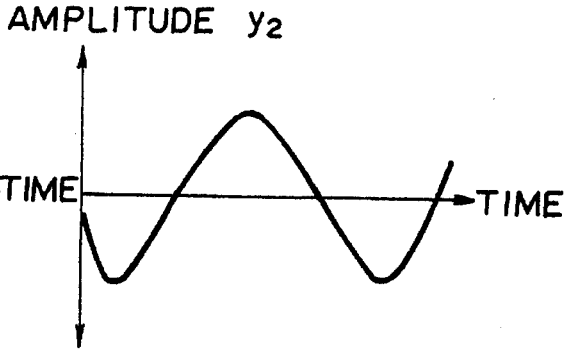
Figure 18G:
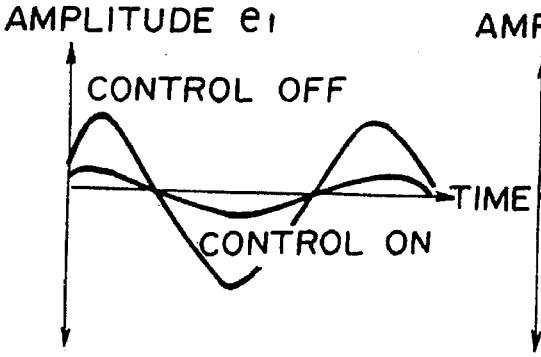
Figure 18H:
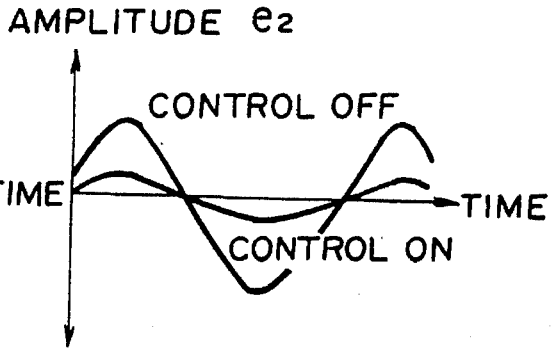

The case where the predetermined factor J is the engine speed, that is, the case where the ratio changing means 42 changes the vibrator control ratio according to the engine speed will be described. FIGS. 16A to 16C respecively show the relation of the amounts of the adjusted reference signals $x_1$ and $x_2$ to the engine speed, the relation of the values of the convergent factors $\alpha_1$ and $\alpha_2$ to the engine speed when the engine speed increases from a low speed range to a high speed range, and the relation of the values of the convergent factors $\alpha_1$ and $\alpha_2$ to the engine speed when the engine speed decreases from the high speed range to the low speed range in the case where the ratio changing means 42 changes the vibrator control ratio according to the engine speed. FIGS. 17A to 17H show damping of the vibration of the vehicle body 1 and the noise in the cabin at 1000 rpm when the vibrator control ratio is changed in the manner shown in FIGS. 16A to 16C, wherein FIG. 17A shows the change of the vibration of the vehicle body 1, FIG. 17B shows the change of the noise in the cabin, FIG. 17C shows the change of the amount of the adjusted reference signal $x_1$, FIG. 17D shows the change of the amount of the adjusted reference signal $x_2$, FIG. 17E shows the change of the amount of the drive signal $y_1$, FIG. 17F shows the change of the amount of the drive signal $y_2$, FIG. 17G shows the change of the amount of the detecting signal $e_1$, and FIG. 17H shows the change of the amount of the detecting signal $e_2$. FIGS. 18A to 18H are the views similar to FIGS. 17A to 17H but at 2500 rpm and FIGS. 19A to 19H are the views similar to FIGS. 17A to 17H but at 4000 rpm.

As can be understood from FIGS. 17A and 17B, when the engine speed is in the low speed range (e.g., 1000 rpm), the level of the vibration of the vehicle body 1 caused by the vibration of the engine E is high and the level of the noise in the cabin caused by the vibration of the engine E is low. Further as can be understood from FIGS. 18A and 18B, when the engine speed is in the middle speed range (e.g., 2500 rpm), the level of the vibration of the vehicle body 1 caused by the vibration of the engine E is substantially equal to the level of the noise in the cabin caused by the vibration of the engine E. Further as can be understood from FIGS. 19A and 19B, when the engine speed is in the high speed range (e.g., 4000 rpm), the level of the vibration of the vehicle body 1 caused by the vibration of the engine E is low and the level of the noise in the cabin caused by the vibration of the engine E is high.

As shown in FIGS. 16A to 16C, the ratio changing means 42 causes the attenuators 40*a* and 40*b* to increase the amount of the adjusted reference signal $x_1$ input into the adaptive filter $F_1$ to the standard value (equal to the amount of the reference signal x as it is output from the amplifier 12) and reduce the adjusted reference signal $x_2$ input into the adaptive filter $F_2$ near zero in the low engine speed range, to gradually reduce the amount of the adjusted reference signal $x_1$ as the engine speed increases and gradually increase the adjusted reference signal $x_2$ as the engine speed increases in the middle engine speed range, and to reduce the adjusted reference signal $x_1$ near zero and increase the amount of the adjusted reference signal $x_2$ to the standard value in the high engine speed range. At the same time, the ratio changing means 42 reduces the convergent factor $\alpha_2$ for the detecting signal $e_2$ from the microphone 2 and sets the convergent factor $\alpha_1$ for the detecting signal $e_1$ from the acceleration sensor 32 to the standard value (a value normally set taking into account the convergence to the optimal control point and the stability of control) in the low engine speed range, and the ratio changing means 42 sets the convergent factor $\alpha_2$ for the detecting signal $e_2$ to the standard value and reduces the convergent factor $\alpha_1$ for the detecting signal $e_1$ in the high engine speed range.

The vibration damping system of this embodiment having the ratio changing means 42 which changes the vibrator control ratio in the manner described above operates as follows.

The acceleration sensor 32 shown in FIG. 15 detects the vibration of the vehicle body 1 and outputs the detecting signal $e_1$ and the microphone 2 detects the noise in the cabin and outputs the detecting signal $e_2$. The detecting signals $e_1$ and $e_2$ are input into the drive control means 6. The drive control means 6 performs calculation with calculation step widths according to the convergent factors $\alpha_1$ and $\alpha_2$ on the basis of the detecting signals $e_1$ and $e_2$ input and adjusts the adaptive filters $F_1$ and $F_2$.

When the engine speed is in the low engine speed range, the ratio changing means 42 sets the convergent factor $\alpha_1$ to the standard value and the convergent factor $\alpha_2$ to s small value as described above. Accordingly, though adjustment of the adaptive filter $F_1$ on the basis of the detecting signal $e_1$ is effected in the normal manner, adjustment of the adaptive filter $F_2$ on the basis of the detecting signal $e_2$ is less effected. That is, when the engine speed is in the low engine speed range, damping of the vibration of the vehicle body 1 is preferentially effected. Further since the ratio changing means 42 sets large the amount of the adjusted reference signal $x_1$ input into the adaptive filter $F_1$ and sets small the amount of the adjusted reference signal $x_2$ input into the adaptive filter $F_2$, the drive signal $y_1$ for the vibrating engine mount 36 is output in the optimal amount but the drive signal $y_2$ for the speaker 4 is output in an amount less than the optimal amount. (See FIGS. 17C and 17D) With this arrangement, the vibration of the vehicle body 1 at the acceleration sensor 32 is greatly damped but the noise in the cabin at the microphone 2 is not so damped in the low engine speed range as shown in FIGS. 17G and 17H. However since the vibration of the vehicle body 1 bothers the passengers more than the noise in the cabin in the low engine speed range and damping of the noise little serves to the passengers, electric power which would be consumed for driving the speaker 4 can be saved by the control described above.

Figure 19A:
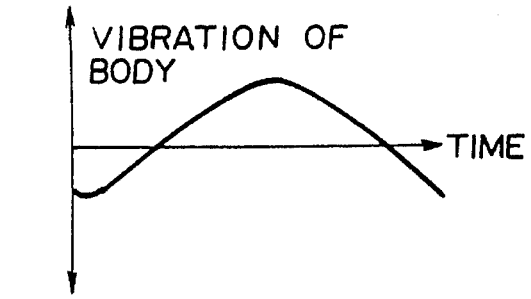
Figure 19B:
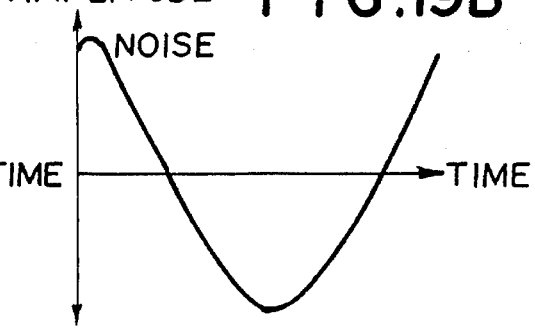
Figure 19C:
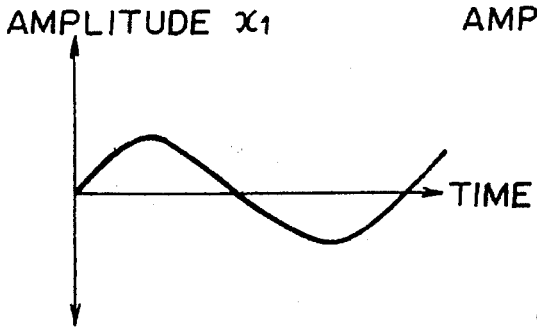
Figure 19D:
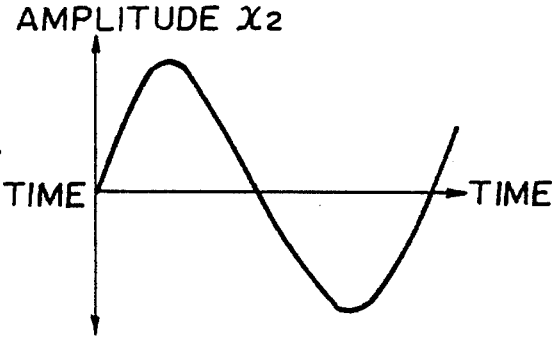
Figure 19E:
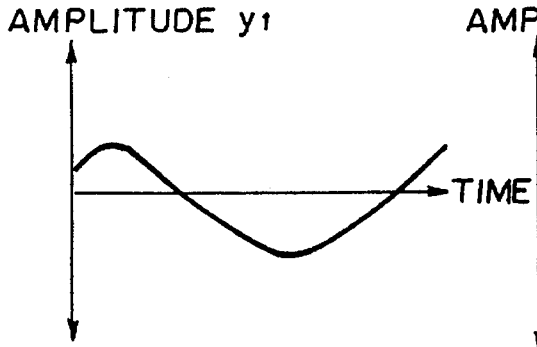
Figure 19F:
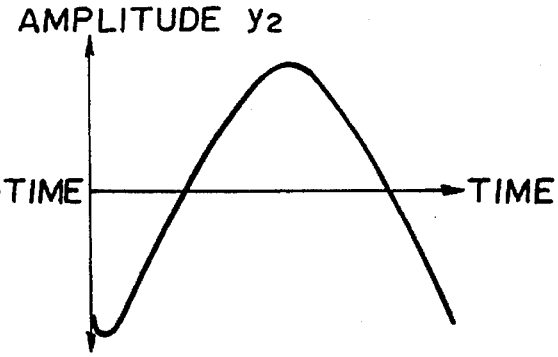
Figure 19G:
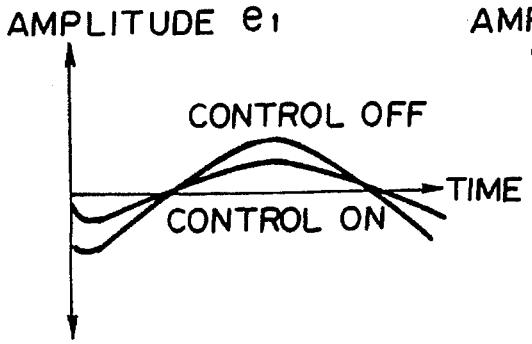
Figure 19H:
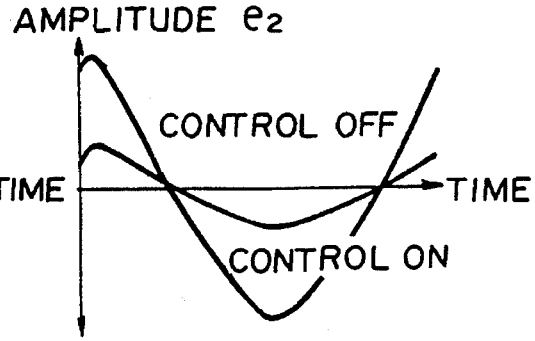

When the engine speed is in the high engine speed range, the ratio changing means 42 sets the convergent factor $\alpha_2$ to the standard value and the convergent factor $e_1$ to s small value as described above, whereby damping of the noise in the cabin is preferentially effected. Further the drive signal $y_2$ for the speaker 4 is output in the optimal amount but the drive signal $y_1$ for the vibrating engine mount 36 is output in an amount less than the optimal amount. (See FIGS. 19C and 19D) With this arrangement, the noise in the cabin at the microphone 2 is greatly damped but the vibration of the vehicle body 1 at the acceleration sensor 32 is not so damped in the high engine speed range as shown in FIGS. 19G and 19H. However since the noise in the cabin bothers the passengers more than the vibration of the vehicle body 1 in the high engine speed range and damping of the vibration of the vehicle body 1 little serves to the passengers, electric power which would be consumed for driving the vibrating engine mount 36 can be saved by the control described above.

In the middle engine speed range, the vibration of the vehicle body 1 is damped in preference to the noise in the cabin below the middle of the range near 2500 rpm, and the noise in the cabin is damped in preference to the vibration of the vehicle body 1 over the middle of the range. At the engine speed near 2500 rpm, the vibration of the vehicle body 1 and the noise in the cabin are damped substantially equally as can be understood from FIGS. 18A to 18H.

Figure 20A:
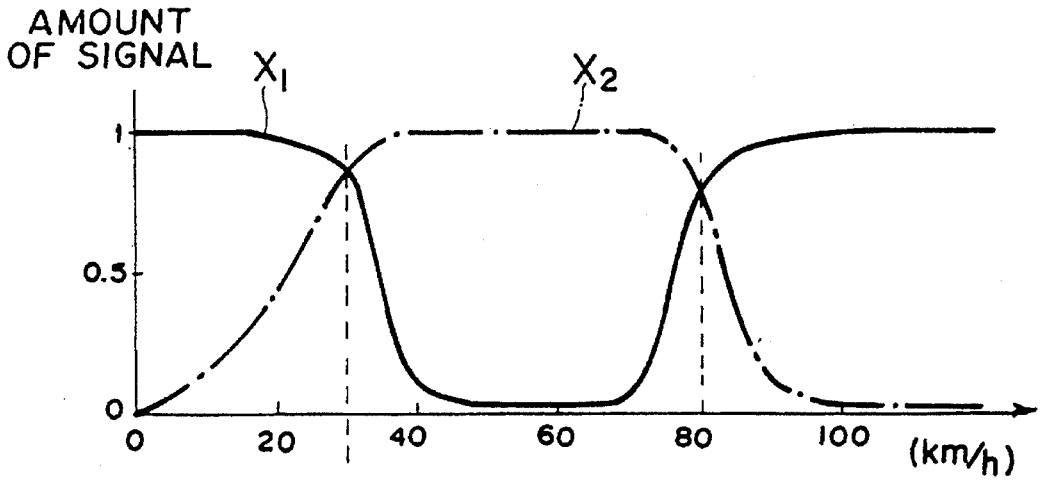
Figure 20B:
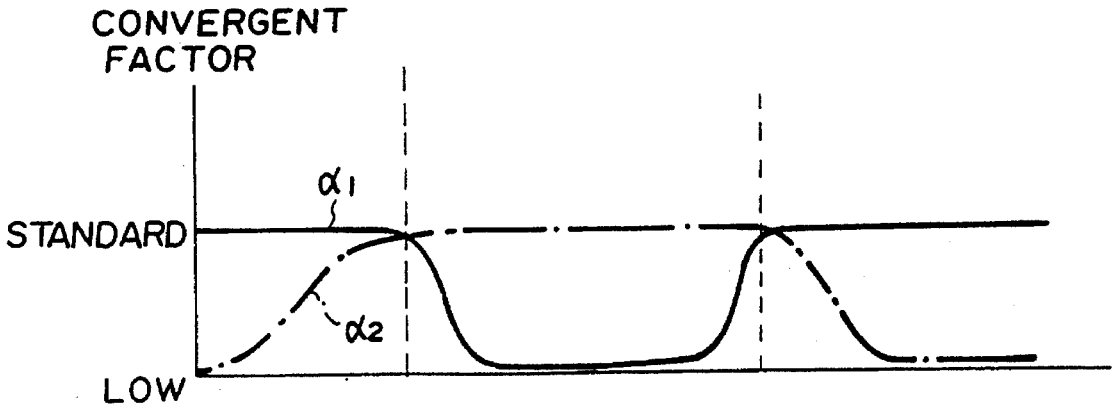

The case where the predetermined factor J is the vehicle speed, that is, the case where the ratio changing means 42 changes the vibrator control ratio according to the vehicle speed will be described, hereinbelow. FIGS. 20A and 20B respecively show the relation of the amounts of the adjusted reference signals $x_1$ and $x_2$ to the vehicle speed, and the relation of the values of the convergent factors $\alpha_1$ and $\alpha_2$ to the vehicle speed when the vibrator control ratio is changed according to the vehicle speed.

As shown in FIGS. 20A and 20B, the ratio changing means 42 causes the attenuators 40*a* and 40*b* to increase the amount of the adjusted reference signal $x_1$ input into the adaptive filter $F_1$ and reduce the adjusted reference signal $x_2$ input into the adaptive filter $F_2$ in the low engine speed range (to nullify the adjusted reference signal $x_2$ when the vehicle speed is zero), to reduce the adjusted reference signal $x_1$ and increase the amount of the adjusted reference signal $x_2$ in the high engine speed range, and to increase the amount of the adjusted reference signal $x_1$ input into the adaptive filter $F_1$ and reduce the adjusted reference signal $x_2$ input into the adaptive filter $F_2$ in the highest vehicle speed range. At the same time, the ratio changing means 42 reduces the convergent factor $\alpha_2$ for the detecting signal $e_2$ from the microphone 2 and sets the convergent factor $\alpha_1$ for the detecting signal $e_1$ from the acceleration sensor 32 to the standard value in the low vehicle speed range, sets the convergent factor $\alpha_2$ for the detecting signal $e_2$ to the standard value and reduces the convergent factor $\alpha_1$ for the detecting signal $e_1$ in the high vehicle speed range, and reduces the convergent factor $\alpha_2$ for the detecting signal $e_2$ from the microphone 2 and sets the convergent factor $\alpha_1$ for the detecting signal $e_1$ from the acceleration sensor 32 to the standard value in the highest vehicle speed range.

In this example, when the vehicle speed is in the low speed range, damping of the vibration of the vehicle body 1 is preferentially effected and the drive signal $y_2$ for the speaker 4 is output in an amount less than the optimal amount (especially when the vehicle speed is zero, the amount of the drive signal $y_2$ for the speaker 4 is nullified). With this arrangement, in the low vehicle speed range where the vibration of the vehicle body 1 bothers the passengers more than the noise in the cabin, the vibration of the vehicle body 1 can be effectively damped, while consumption of the electric power is suppressed by less driving the speaker 4 driving of which little serves to the passengers. In the high vehicle speed range, damping of the noise in the cabin is preferentially effected and the drive signal $y_1$ for the vibrating engine mount 36 is output in an amount less than the optimal amount. With this arrangement, in the high vehicle speed range where the noise in the cabin bothers the passengers more than the vibration of the vehicle body 1, the noise in the cabin can be effectively damped, while consumption of the electric power is suppressed by less driving the vibrating engine mount 36 driving of which little serves to the passengers. In the highest vehicle speed range, damping of the vibration of the vehicle body 1 is preferentially effected and the drive signal $y_2$ for the speaker 4 is output in an amount less than the optimal amount. With this arrangement, in the highest vehicle speed range where the level of noise such as road noise, wind noise or the like which is not caused due to the vibration of the power unit increases and satisfactory vibration damping effect cannot be obtained even if the speaker 4 is driven, consumption of the electric power is suppressed by less driving the speaker 4.

Figure 21A:
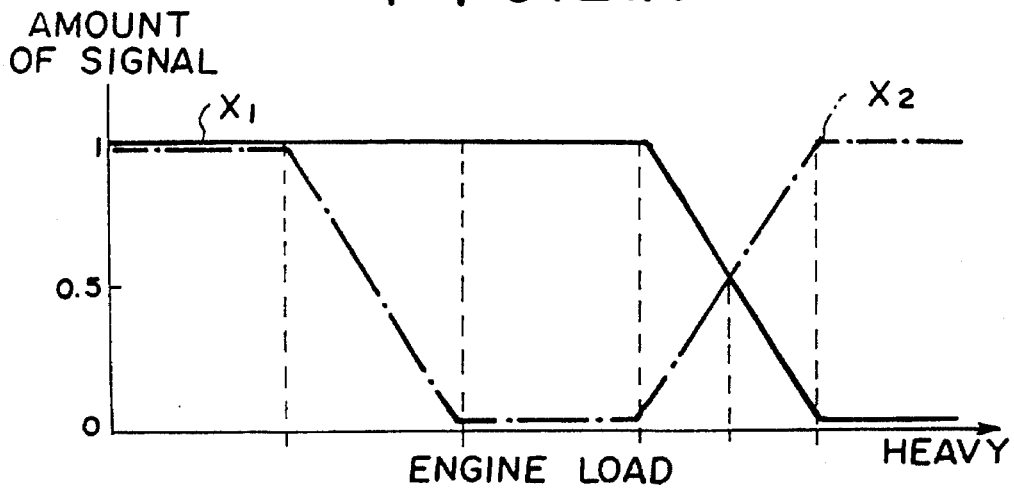
FIGS. 21A to 21C are views respectively view showing the relation of the amounts of the adjusted reference signals to the engine load, the relation of the values of the convergent factors to the engine load when the engine load increases, and the relation of the values of the convergent factors to the engine load when the engine load decreases in the case where the ratio changing means shown in FIG. 15 changes the vibrator control ratio according to the engine load, the broken lines in the drawings showing the correspondence therebteween.
Figure 21B:
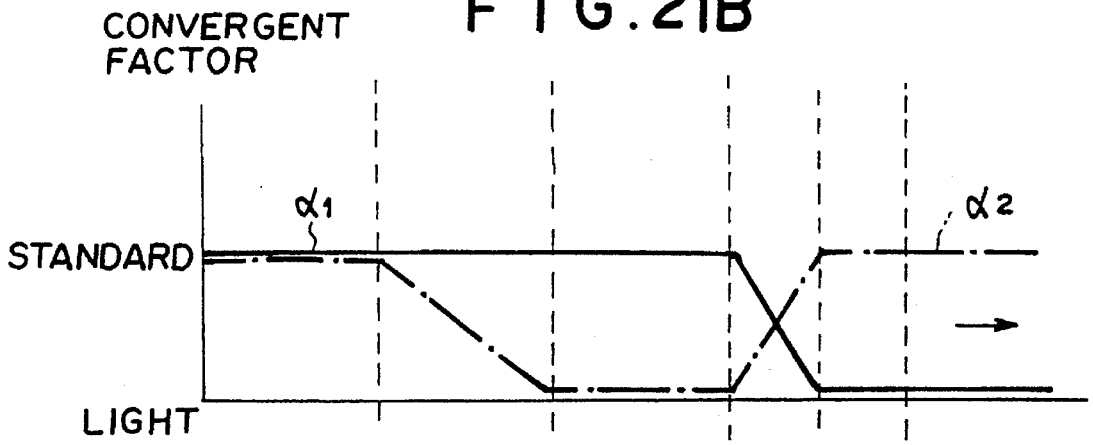
Figure 21C:
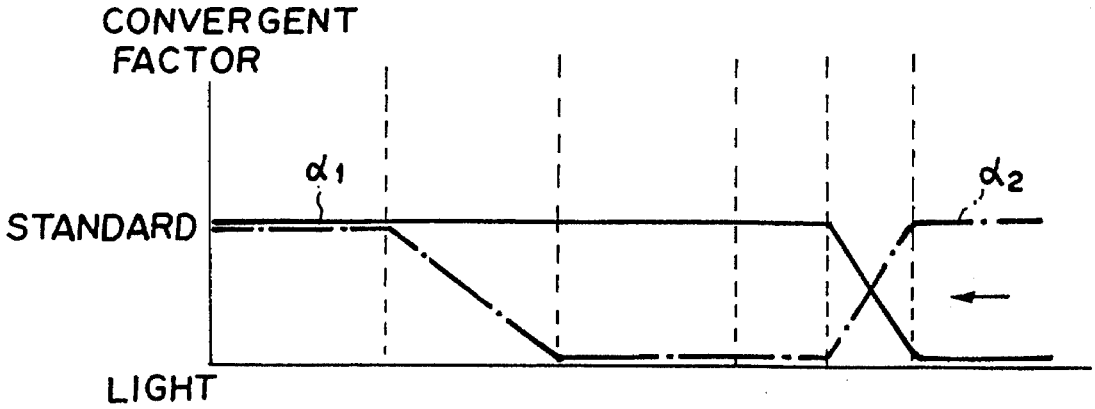

The case where the predetermined factor J is the load on the engine, that is, the case where the ratio changing means 42 changes the vibrator control ratio according to the engine load will be described, hereinbelow. FIGS. 21A to 21C respecively show the relation of the amounts of the adjusted reference signals $x_1$ and $x_2$ to the engine load, the relation of the values of the convergent factors $\alpha_1$ and $\alpha_2$ to the engine load when the engine load increases, and the relation of the values of the convergent factors $\alpha_1$ and $\alpha_2$ to the engine load when the engine load decreases in the case where the ratio changing means 42 changes the vibrator control ratio according to the engine load.

As shown in FIGS. 21A to 21C, the ratio changing means 42 causes the attenuators 40*a* and 40*b* to increase the amount of the adjusted reference signal $x_1$ input into the adaptive filter $F_1$ and reduce the adjusted reference signal $x_2$ input into the adaptive filter $F_2$ when the engine load exceeds a first predetermined value, and to reduce the adjusted reference signal $x_1$ and increase the amount of the adjusted reference signal $x_2$ when the engine load exceeds a second predetermined value. At the same time, the ratio changing means 42 reduces the convergent factor $\alpha_2$ for the detecting signal $e_2$ from the microphone 2 and sets the convergent factor $\alpha_1$ for the detecting signal $e_1$ from the acceleration sensor 32 to the standard value when the engine load exceeds the first predetermined value, and the ratio changing means 42 sets the convergent factor $\alpha_2$ for the detecting signal $e_2$ to the standard value and reduces the convergent factor $\alpha_1$ for the detecting signal $e_1$ when the engine load exceeds the second predetermined value.

In this example, when the engine load exceeds the first predetermined value, damping of the vibration of the vehicle body 1 is preferentially effected and the drive signal $y_2$ for the speaker 4 is output in an amount less than the optimal amount. With this arrangement, when the engine load is between the first and second predetermined values where the vibration of the vehicle body 1 bothers the passengers more than the noise in the cabin, the vibration of the vehicle body 1 can be effectively damped, while consumption of the electric power is suppressed by less driving the speaker 4 driving of which little serves to the passengers. When the engine load exceeds the second predetermined, damping of the noise in the cabin is preferentially effected and the drive signal $y_1$ for the vibrating engine mount 36 is output in an amount less than the optimal amount. With this arrangement, when the engine load is heavier than the second predetermined value where the level of the vibration of the vehicle body 1 is too high to satisfactorily damp by driving the vibrating engine mount 36, consumption of the electric power is suppressed by less driving the vibrating engine mount 36.

Figure 22A:
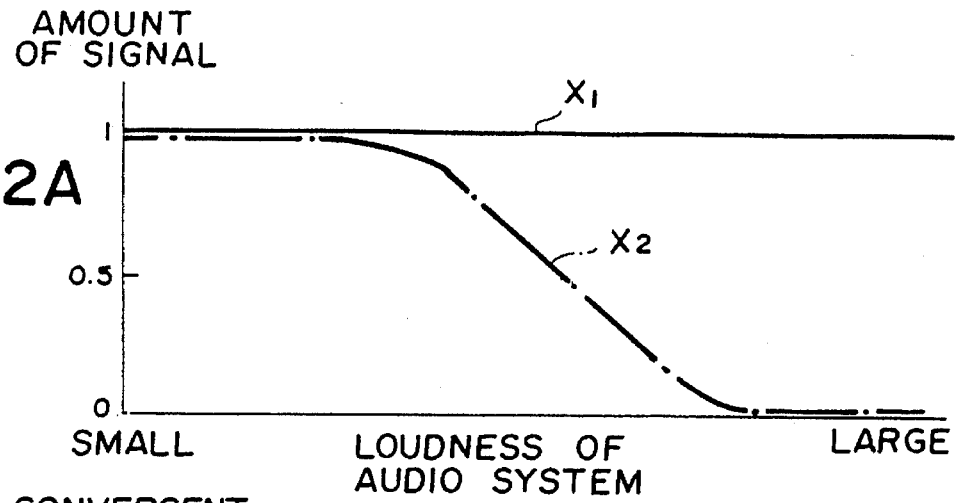
FIGS. 22A and 22B are views respectively showing the relation of the amounts of the reference signals to the loudness of the audio system and the relation of the convergent factors to the loudness of the audio system when the ratio changing means shown in FIG. 15 changes the vibrator control ratio according to the loudness of the audio system.
Figure 22B:
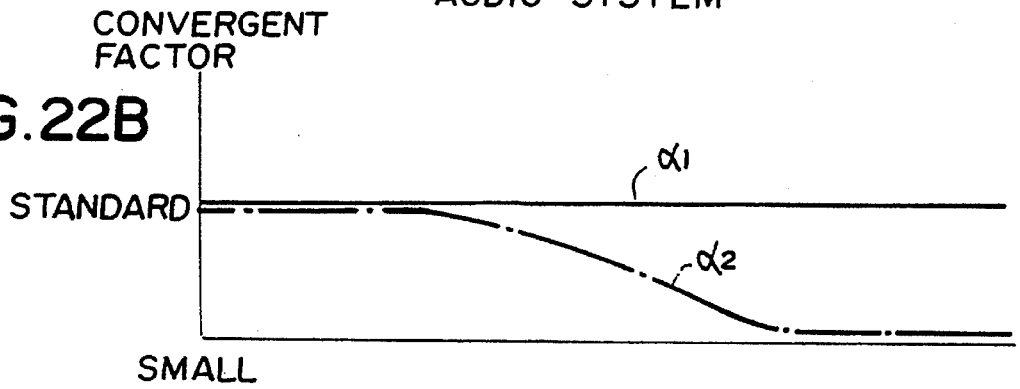

The case where the predetermined factor J is the loudness of the audio system on the vehicle, that is, the case where the ratio changing means 42 changes the vibrator control ratio according to the loudness of the audio system on the vehicle will be described, hereinbelow. FIGS. 22A and 22B respecively show the relation of the amounts of the adjusted reference signals $x_1$ and $x_2$ to the loudness of the audio system, and the relation of the values of the convergent factors $\alpha_1$ and $\alpha_2$ to the loudness of the audio system in the case where the ratio changing means 42 changes the vibrator control ratio according to the loudness of the audio system.

As shown in FIGS. 22A and 22B, the ratio changing means 42 causes the attenuators 40*a* and 40*b* to increase the amount of the adjusted reference signal $x_1$ input into the adaptive filter $F_1$ and reduce the adjusted reference signal $x_2$ input into the adaptive filter $F_2$ when the loudness of the audio system exceeds a predetermined value. At the same time, the ratio changing means 42 reduces the convergent factor $\alpha_2$ for the detecting signal $e_2$ from the microphone 2 and sets the convergent factor $\alpha_1$ for the detecting signal $e_1$ from the acceleration sensor 32 to the standard value when the loudness of the audio system exceeds the predetermined value.

In this example, when the loudness of the audio system exceeds the predetermined value, damping of the vibration of the vehicle body 1 is preferentially effected and the drive signal $y_2$ for the speaker 4 is output in an amount less than the optimal amount. With this arrangement, when the loudness of the audio system is higher than the predetermined value where the level of the sound of the audio system is too high and the noise in the cabin cannot be satisfactorily damped by driving of the speaker 4, consumption of the electric power is suppressed by less driving the speaker 4.

Figure 23A:
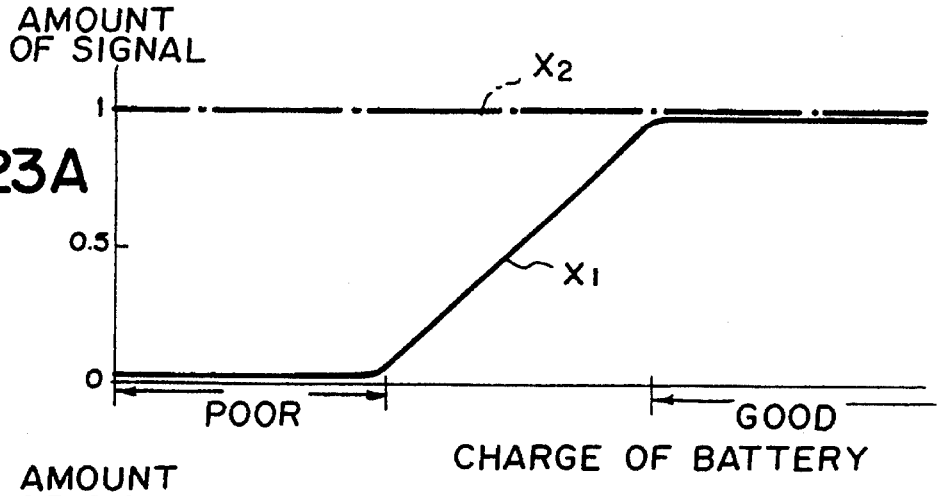
FIGS. 23A and 23B are views respectively showing the relation of the amounts of the reference signals to the degree of charge of the battery and the relation of the convergent factors to the degree of charge of the battery when the ratio changing means shown in FIG. 15 changes the vibrator control ratio according to the degree of charge of the battery.
Figure 23B:
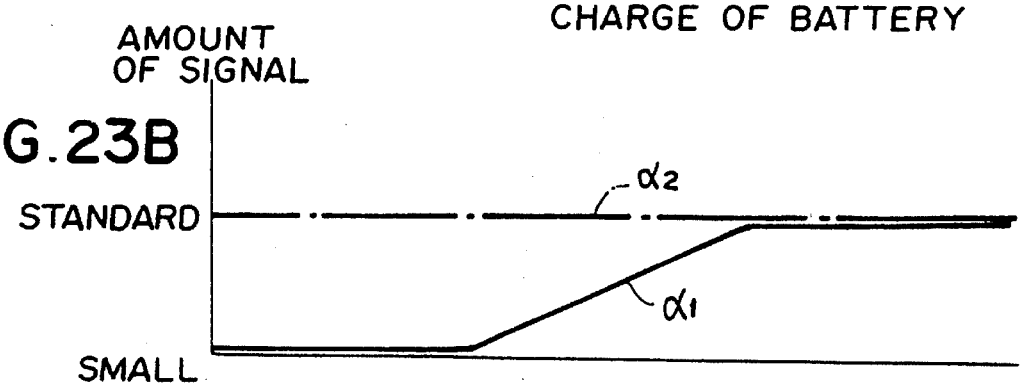

The case where the predetermined factor J is the degree of charge of the battery on the vehicle, that is, the case where the ratio changing means 42 changes the vibrator control ratio according to the degree of charge of the battery will be described, hereinbelow. FIGS. 23A and 23B respecively show the relation of the amounts of the adjusted reference signals $x_1$ and $x_2$ to the degree of charge of the battery, and the relation of the values of the convergent factors $\alpha_1$ and $\alpha_2$ to the degree of charge of the battery in the case where the ratio changing means 42 changes the vibrator control ratio according to the degree of charge of the battery.

As shown in FIGS. 23A and 23B, the ratio changing means 42 causes the attenuators 40*a* and 40*b* to reduce the amount of the adjusted reference signal $x_1$ input into the adaptive filter $F_1$ when the degree of charge of the battery is lower than a predetermined value while keeping the amount of the adjusted reference signal $x_2$ input into the adaptive filter $F_2$ large irrespective of the degree of charge of the battery. At the same time, the ratio changing means 42 reduces the convergent factor $\alpha_1$ for the detecting signal $e_1$ from the acceleration sensor 32 when the degree of charge of the battery is lower than the predetermined value while keeping the convergent factor $\alpha_2$ for the detecting signal $e_2$ from the microphone 2 at the standard value irrespective of the degree of charge of the battery.

In this example, when the degree of charge of the battery is poor, damping of the noise is preferentially effected and the drive signal $y_1$ for the vibrating engine mount 36 is output in an amount less than the optimal amount. The vibrating engine mount 36 consumes electric power more than the speaker 4, and accordingly, the vibrating engine mount 36 is less driven until the degree of charge of the battery is improved.

Figure 24A:
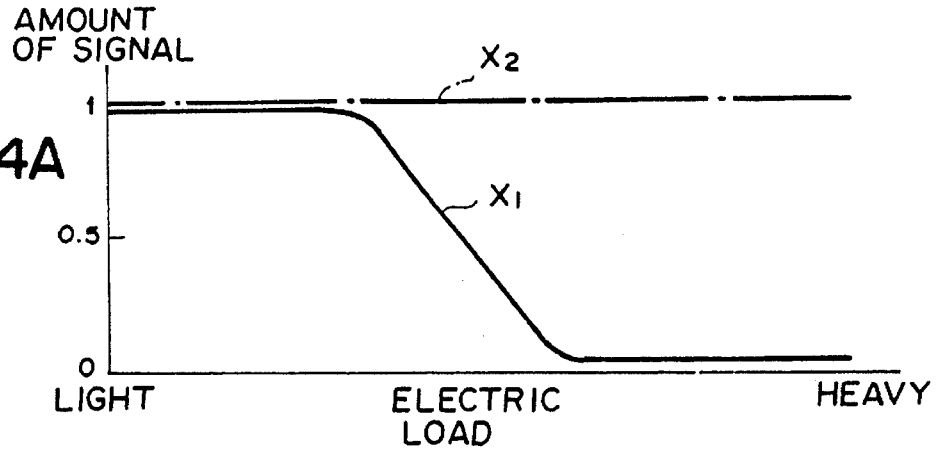
FIGS. 24A and 24B are views respectively showing the relation of the amounts of the reference signals to the electric load and the relation of the convergent factors to the electric load when the ratio changing means shown in FIG. 15 changes the vibrator control ratio according to the electric load.
Figure 24B:
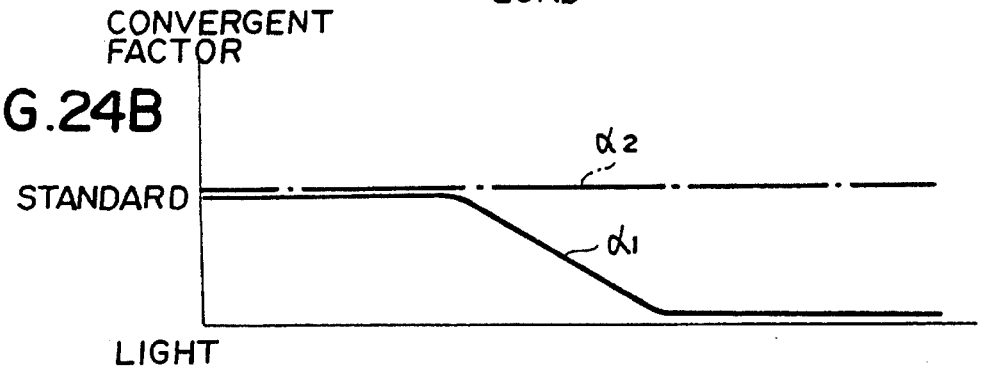

The case where the predetermined factor J is the electric load, that is, the case where the ratio changing means 42 changes the vibrator control ratio according to the electric load will be described, hereinbelow. FIGS. 24A and 24B respecively show the relation of the amounts of the adjusted reference signals $x_1$ and $x_2$ to the electric load, and the relation of the values of the convergent factors $\alpha_1$ and $\alpha_2$ to the electric load in the case where the ratio changing means 42 changes the vibrator control ratio according to the electric load.

As shown in FIGS. 24A and 24B, the ratio changing means 42 causes the attenuators 40*a* and 40*b* to reduce the amount of the adjusted reference signal $x_1$ input into the adaptive filter $F_1$ when the electric load exceeds a predetermined value while keeping the amount of the adjusted reference signal $x_2$ input into the adaptive filter $F_2$ large irrespective of the electric load. At the same time, the ratio changing means 42 reduces the convergent factor $\alpha_1$ for the detecting signal $e_1$ from the acceleration sensor 32 when the electric load exceeds the predetermined value while keeping the convergent factor $\alpha_2$ for the detecting signal $e_2$ from the microphone 2 at the standard value irrespective of the electric load.

In this example, when the electric load is heavy, damping of the noise is preferentially effected and the drive signal $y_1$ for the vibrating engine mount 36 is output in an amount less than the optimal amount. The vibrating engine mount 36 consumes electric power more than the speaker 4, and accordingly, the vibrating engine mount 36 is less driven in order to reduce the electric load.

Figure 25A:
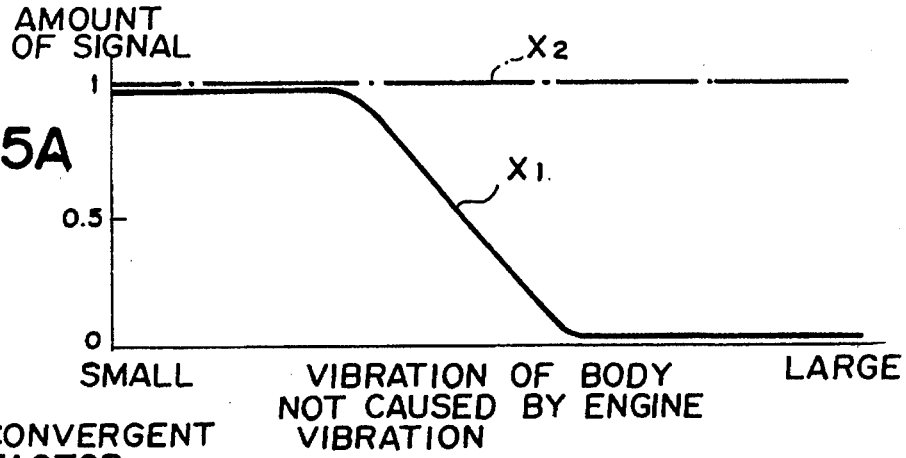
FIGS. 25A and 25B are views respectively showing the relation of the amounts of the reference signals to the vibration of the vehicle body not caused by the engine vibration and the relation of the convergent factors to the vibration of the vehicle body not caused by the engine vibration when the ratio changing means shown in FIG. 15 changes the vibrator control ratio according to the vibration of the vehicle body not caused by the engine vibration.
Figure 25B:
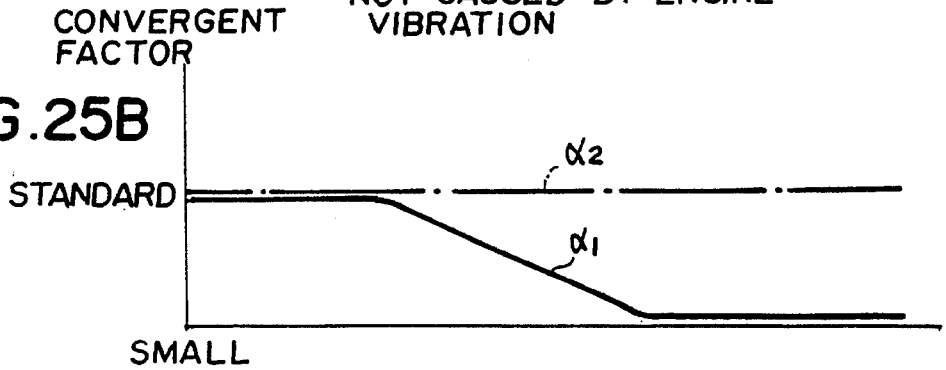

The case where the predetermined factor J is the vibration of the vehicle body 1 which is not caused by the vibration of the engine, that is, the case where the ratio changing means 42 changes the vibrator control ratio according to the vibration of the vehicle body 1 which is not caused by the vibration of the engine will be described, hereinbelow. FIGS. 25A and 25B respecively show the relation of the amounts of the adjusted reference signals $x_1$ and $x_2$ to the vibration of the vehicle body 1 which is not caused by the vibration of the engine, and the relation of the values of the convergent factors $\alpha_1$ and $\alpha_2$ to the vibration of the vehicle body 1 which is not caused by the vibration of the engine in the case where the ratio changing means 42 changes the vibrator control ratio according to the vibration of the vehicle body 1 which is not caused by the vibration of the engine.

As shown in FIGS. 25A and 25B, the ratio changing means 42 causes the attenuators 40*a* and 40*b* to reduce the amount of the adjusted reference signal $x_1$ input into the adaptive filter $F_1$ and increase the adjusted reference signal $x_2$ input into the adaptive filter $F_2$ when the vibration of the vehicle body 1 which is not caused by the vibration of the engine exceeds a predetermined level. At the same time, the ratio changing means 42 reduces the convergent factor $\alpha_1$ for the detecting signal $e_1$ from the acceleration sensor 32 and sets the convergent factor $\alpha_2$ for the detecting signal $e_2$ from the microphone 2 to the standard value when the vibration of the vehicle body 1 which is not caused by the vibration of the engine exceeds a predetermined level.

In this example, when the vibration of the vehicle body 1 which is not caused by the vibration of the engine exceeds a predetermined level, damping of the noise in the cabin is preferentially effected and the drive signal $y_1$ for the vibrating engine mount 36 is output in an amount less than the optimal amount. With this arrangement, when the level of the vibration of the vehicle body 1 which is not caused by the vibration of the engine is very high and the vibration of the vehicle body 1 cannot be satisfactorily damped by driving the vibrating engine mount 36, consumption of the electric power is suppressed by less driving the vibrating engine mount 36.

Figure 26:
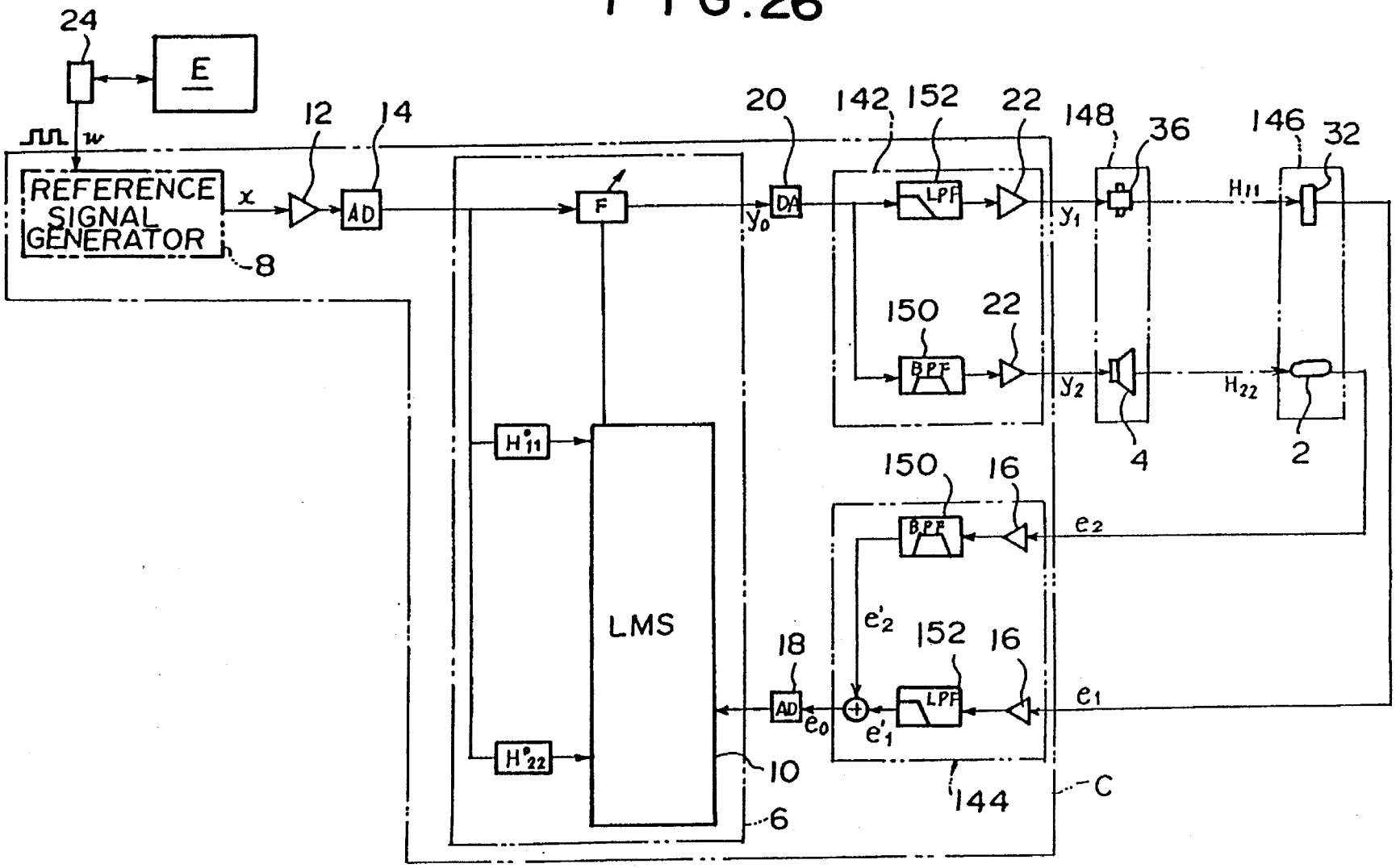
FIG. 26 is a schematic view showing the structure of the controller employed in the vibration damping system in accordance with a third embodiment of the present invention.

FIG. 26 is a schematic view showing the structure of the controller employed in the vibration damping system in accordance with a third embodiment of the present invention. The vibration damping system of this embodiment is basically the same as the first embodiment, and accordingly the parts analogous to those in the first embodiment will be given the same reference numerals and will not be described in detail here.

As shown in FIG. 26, the controller C comprises a reference signal generating means 8 which generates a reference signal x on the basis of an ignition pulse signal w generated by an ignition coil 24, a drive control means 6 which generates a drive signal $y_0$ for driving the vibrating engine mount 36 and the speaker 4 on the basis of the reference signal x. The controller C further comprises a drive signal separator 142 which separates the drive signal $y_0$ generated by the drive control means 6 into a low frequency drive signal $y_1$ and a high frequency drive signal $y_2$ and a detecting signal mixer 144 which mixes the detecting signal $e_1$ from the acceleration sensor 32 and the detecting signal $e_2$ from the microphone 2 into a detecting signal $e_0$. Further the controller C has therein an amplifier 12 which amplifies the reference signal x, an A/D convertor 14 which converts the reference signal x into a digital signal, a D/A convertor 20 which converts the drive signal $y_0$ into an analog signal and an A/D convertor 18 which converts the detecting signal $e_0$ into a digital signal.

The vibration damping system of this embodiment is characterized in that the controller C has the drive signal separator 142 and the detecting signal mixer 144. This point will be described in detail, hereinbelow. As shown in FIG. 26, one acceleration sensor 32 and one microphone 2 form a vibration sensor group 146 and one vibrating engine mount 36 and one speaker 4 form a vibrator group 148.

The acceleration sensor 32 detects the vibration of the vehicle body 1 and outputs the detecting signal $e_1$ and the microphone 2 detects the noise in the cabin and outputs the detecting signal $e_2$. The detecting signals $e_1$ and $e_2$ are input into the detecting signal mixer 144 in the controller C. The detecting signal mixer 144 comprises amplifiers 16 which amplify the detecting signals $e_1$ and $e_2$, a band pass filter 150 which transmits only a component in a predetermined high frequency band of the detecting signal $e_2$ from the microphone 2, and a low pass filter 152 which transmits a component having a frequency lower than a predetermined frequency of the detecting signal $e_1$ from the acceleration sensor 32. The frequency band which the band pass filter 150 transmits does not overlap the frequency band which the low pass filter 152 transmits. The high frequency detecting signal $e_2'$ passing through the band pass filter 150 and the low frequency detecting signal $e_1'$ passing through the low pass filter 152 are mixed together into a detecting signal $e_0$, which is input into the drive control means 6.

The drive control means 6 comprises an adaptive filter F which adjusts every moment the phase and the amplitude of the reference signal x and an adaptive algorithm section 10 which adjusts the adaptive filter F so that the detecting signal $e_0$ input from the detecting signal mixer 144 is minimized. In this embodiment, Least Mean Square Method is employed as the adaptive algorithm for adjusting the adaptive filter F and for this purpose, the drive control means 6 is provided with digital filters $H^{\circ}_{LM}$ (L standing for 1, 2 and M standing for 1, 2) which are modeled on the transmission properties between the vibrating engine mount 36 and the acceleration sensor 32 and between the speaker 4 and the microphone 2.

The drive control means 6 performs calculation on the basis of the detecting signal $e_0$ input from the detecting signal mixer 144 and adjusts the adaptive filter F every moment, thereby generating a drive signal $y_0$ for driving the vibrating engine mount 36 and the speaker 4. The drive signal $y_0$ generated by the drive control means 6 is input into the drive signal separator 142 and is separated into a low frequency drive signal $y_1$ for driving the vibrating engine mount 36 and a high frequency drive signal $y_2$ for driving the speaker 4. That is, the drive signal separator 142 comprises a band pass filter 150 which transmits only a component in a predetermined high frequency band of the drive signal $y_0$, and a low pass filter 152 which transmits a component having a frequency lower than a predetermined frequency of the drive signal $y_0$, and amplifiers 22 which amplify the signals passing through the respective filters 150 and 152, and outputs a low frequency drive signal $y_1$ and a high frequency drive signal $y_2$ by separating the drive signal $y_0$. The vibrating engine mount 36 and the speaker 4 which form the vibrator group 148 are respectively drive by the low frequency drive signal $y_1$ and the high frequency drive signal $y_2$ to damp the vibration of the vehicle body 1 and the noise in the cabin.

In accordance with this embodiment, the vibration of the vehicle body 1 and the noise in the cabin can be effectively damped without increasing the operational load on the drive control means 6.

Though formed of the band pass filter 150 and the low pass filter 152 in this embodiment, the drive signal separator 142 may be formed of an electric circuit having a capacitor and/or a winding. Modifications of the drive signal separator 142 are shown in FIGS. 27, 29 and 31.

Figure 27:
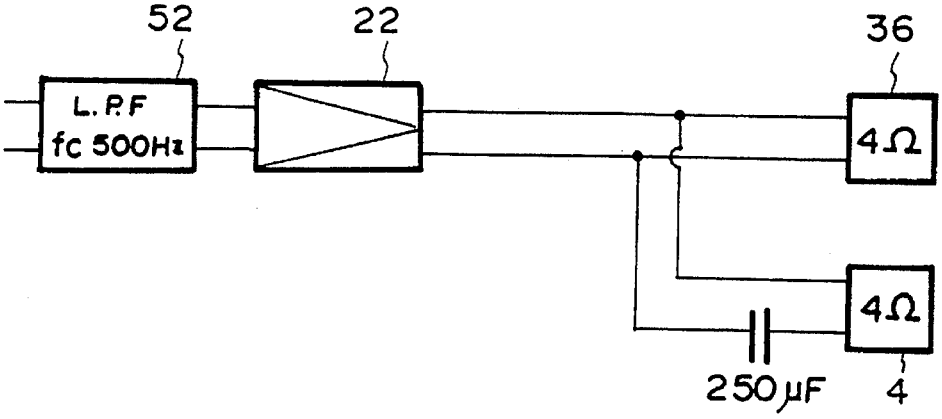
FIG. 27 is a circuit diagram showing a modification of the drive signal separator.
Figure 28:
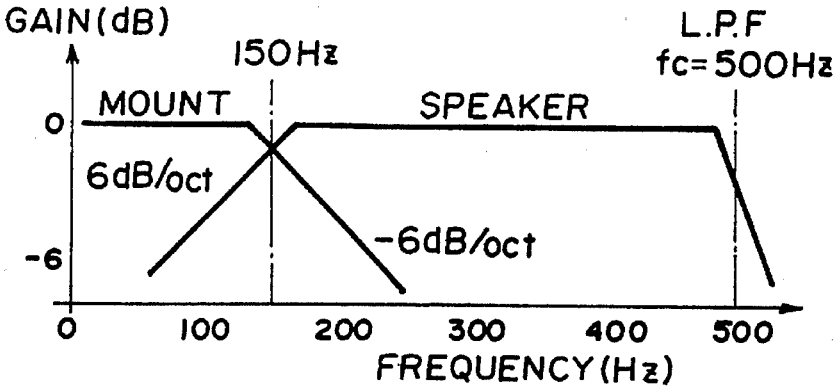
FIG. 28 is a view showing the frequency separation properties of the circuit shown in FIG. 27.

FIG. 27 is a circuit diagram showing a modification of the drive signal separator 142, and FIG. 28 is a view showing the frequency separation properties of the circuit shown in FIG. 27.

Figure 29:
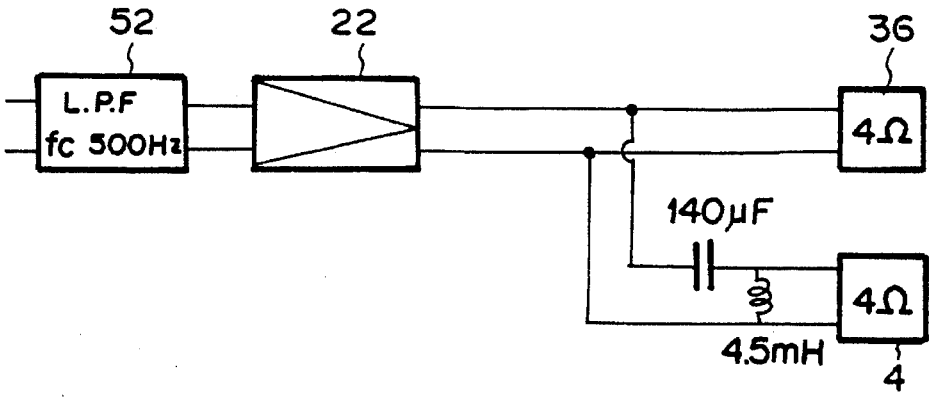
FIG. 29 is a circuit diagram showing another modification of the drive signal separator.
Figure 30:
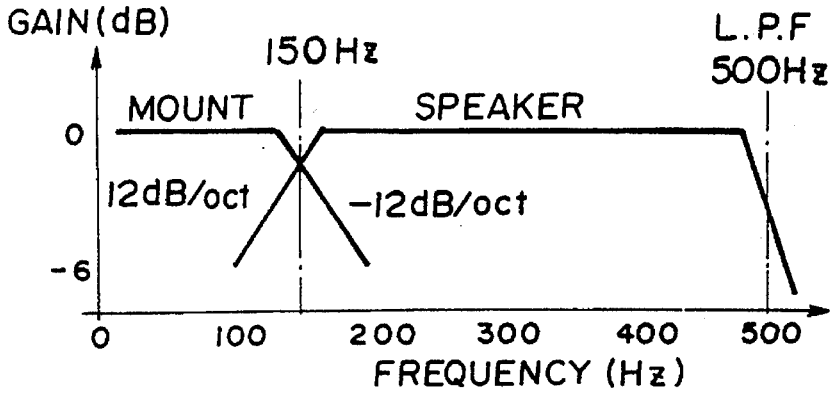
FIG. 30 is a view showing the frequency separation properties of the circuit shown in FIG. 29.

FIG. 29 is a circuit diagram showing another modification of the drive signal separator 142, and FIG. 30 is a view showing the frequency separation properties of the circuit shown in FIG. 29.

Figure 31:
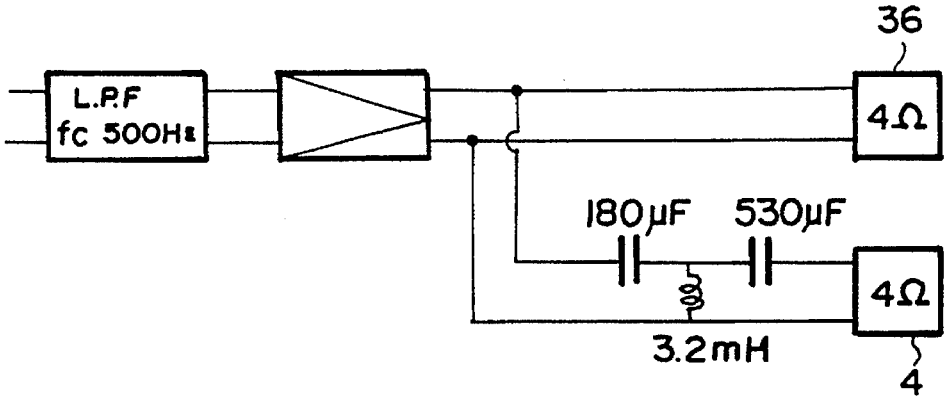
FIG. 31 is a circuit diagram showing still another modification of the drive signal separator.
Figure 32:
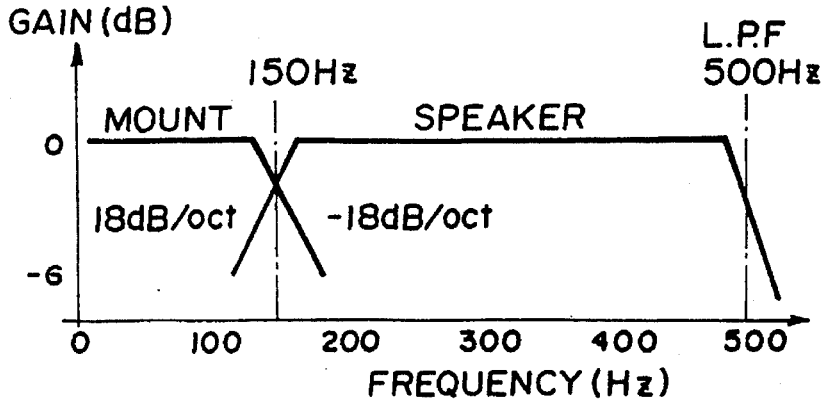
FIG. 32 is a view showing the frequency separation properties of the circuit shown in FIG. 30.

FIG. 31 is a circuit diagram showing still another modification of the drive signal separator 142, and FIG. 32 is a view showing the frequency separation properties of the circuit shown in FIG. 31.

The circuits and the frequency separation properties shown in FIGS. 27 to 32 will be apparent to those skilled in the art and accordingly will not be described here.

The vibration damping system in accordance with the present invention may be variously modified without limiting to the embodiments described above. Further, though, in the embodiments described above, an optimization technique (LMS) is employed in the calculation performed by the drive control means, the present invention can also be applied to the vibration damping system having a drive control means which performs calculation without using an optimization technique.

What is claimed is:

1. A vibration damping system for a vehicle comprising a vibration detecting means which detects vibration of solid elements on the vehicle and vibration of air inside the vehicle, a first vibrator provided in the vehicle body which supports a power unit relative to the vehicle body and directly vibrates the vehicle body, a second vibrator provided in the vehicle body which directly vibrates air inside the vehicle body, a drive control means which performs calculation on the basis of a detecting signal from the vibration detecting means and controls the first and the second vibrators in accordance with the calculation so that the vibration of the solid element and the vibration of air inside the vehicle body are damped, and a ratio changing means which changes a relative vibration control ratio between the first and second vibrators according to a condition of a predetermined factor which affects a magnitude of the vibration of the solid elements and the air within the vehicle body.

2. A vibration damping system as defined in claim 1 in which said ratio changing means changes the relative vibration control ratio by changing a ratio of operational power of the drive control means allotted to the control of the first vibrator and operational power of the drive control means allotted to the control of the second vibrator.

3. A vibration damping system as defined in claim 2, wherein the ratio changing means changes a frequency of inputting the respective detecting signals from an acceleration sensor and a microphone into the drive control means.

4. A vibration damping system as defined in claim 1 in which said ratio changing means changes the relative vibration control ratio by changing a ratio of a proportionate amount of the vibration of the first vibrator set by the drive control means to an amount of the vibration of the first vibrator optimal to damp the vibration of the solid element to proportionate amount of the vibration of the second vibrator set by the drive control means to an amount of the vibration of the second vibrator optimal to damp the vibration of the air inside the vehicle body.

5. A vibration damping system as defined in claim 4, wherein the ratio changing means changes an amount of first and second reference signals, used for the drive control of the first and second vibrators, respectively, that are input into the drive control means, and an amount of the respective detecting signals from an acceleration sensor and a microphone that are input into the drive control means.

6. A vibration damping system as defined in any one of claims 1, 2 and 4 in which said predetermined factor of the vehicle is engine speed.

7. A vibration damping system as defined in claim 6 in which said ratio changing means changes the relative vibration control ratio so that a fraction of the relative vibration control ratio for the second vibrator is increased when the engine speed increases.

8. A vibration damping system as defined in any one of claims 1, 2 and 4 in which said predetermined factor of the vehicle is vehicle speed.

9. A vibration damping system as defined in claim 8 in which said ratio changing means changes the relative vibration control ratio so that a fraction of the relative vibration control ratio for the second vibrator is increased when the vehicle speed is in a high speed range, and the fraction of the relative vibration control ratio for the first vibrator is increased when the vehicle speed is in a low speed range and in the highest speed range.

10. A vibration damping system as defined in any one of claims 1, 2 and 4 in which said predetermined factor of the vehicle is a loudness of an audio system on the vehicle.

11. A vibration damping system as defined in claim 10 in which said ratio changing means changes the relative vibration control ratio so that a fraction of the vibrator control ratio for the first vibrator is increased when the loudness of the audio system in the vehicle increases.

12. A vibration damping system as defined in any one of claims 1, 2 and 4 in which said predetermined factor of the vehicle is a degree of opening of the window.

13. A vibration damping system as defined in claim 12 in which said ratio changing means changes the relative vibration control ratio so that a fraction of the relative vibration control ratio for the first vibrator is increased when the degree of opening of the window increases.

14. A vibration damping system as defined in any one of claims 1, 2 and 4 in which said predetermined factor of the vehicle is a number of passengers in the vehicle.

15. A vibration damping system as defined in claim 14 in which said ratio changing means changes the relative vibration control ratio so that a fraction of the relative vibration control ratio for the first vibrator is increased when the number of passengers in the vehicle increases.

16. A vibration damping system as defined in any one of claims 1, 2 and 4 in which said predetermined factor of the vehicle is a level of noise included in the detecting signal from the vibration detecting means.

17. A vibration damping system as defined in claim 16 in which said ratio changing means changes the relative vibration control ratio so that a fraction of the relative vibration control ratio for the first vibrator is decreased when the noise of the first vibrator included in the detecting signal from the vibration detecting means increases, and a fraction of the relative vibration control ratio for the second vibrator is decreased when the noise of the second vibrator included in the detecting signal from the vibration detecting means increases.

18. A vibration damping system as defined in any one of claims 1, 2 and 4 in which said predetermined factor of the vehicle is an electric load.

19. A vibration damping system as defined in claim 18 in which said ratio changing means changes the relative vibration control ratio so that a fraction of the relative vibration control ratio for the second vibrator is increased when the electric load increases.

20. A vibration damping system as defined in any one of claims 1, 2 and 4 in which said predetermined factor of the vehicle is an acceleration and deceleration of the vehicle and said ratio changing means changes the relative vibration control ratio so that a fraction of the relative vibration control ratio for the first vibrator is increased when the acceleration or deceleration of the vehicle increases.

21. A vibration damping system as defined in any one of claims 1, 2 and 4 in which said predetermined factor of the vehicle is air flow of an air-conditioner on the vehicle and said ratio changing means changes the relative vibration control ratio so that a faction of the relative vibration control ratio for the first vibrator is increased when the air flow increases.

22. A vibration damping system as defined in any one of claims 1, 2 and 4 in which said predetermined factor of the vehicle is whether the vibrators are in a normal condition or in an abnormal condition, and said ratio changing means changes the relative vibration control ratio so that a fraction of the relative vibration control ratio for the other vibrator is increased when one of the vibrators is in the abnormal condition.

23. A vibration damping system as defined in any one of claims 1, 2 and 4 in which said predetermined factor of the vehicle is the vibration of the power unit, and said ratio changing means changes the relative vibration control ratio so that a fraction of the relative vibration control ratio for the first vibrator is increased when the amplitude of a low frequency component of the vibration of the power unit increases and a fraction of the relative vibration control ratio for the second vibrator is increased when an amplitude of the high frequency component of the vibration of the power unit increases.

24. A vibration damping system as defined in any one of claims 1, 2 and 4 further comprising a manual ratio setting means for manually setting the relative vibration control ratio.

25. A vibration damping system for a vehicle comprising a vibration detecting means which detects vibration of solid elements on the vehicle and vibration of air inside the vehicle, a vibrator group consisting of a first vibrator which supports a power unit relative to the vehicle body and directly vibrates the vehicle body and a second vibrator which directly vibrates air inside the vehicle body, and a drive control means which performs calculation on the basis of a detecting signal from the vibration detecting means and outputs a single drive signal to the vibrator group in accordance with the calculation, and a drive signal separating means which separates the single drive signal by frequency into first and second drive signals for the first and second vibrators forming the vibrator group, the first and second vibrators forming the vibrator group being driven respectively by the first and second drive signals.

26. A vibration damping system as defined in claim 25 wherein the drive signal separating means separates the signal drive signal into a low frequency signal component for the first vibrator and a high frequency signal component for the second vibrator.

27. A vibration damping system for a vehicle comprising a vibration sensor group consisting of a first vibration sensor which detects vibration of solid elements on the vehicle and a second vibration sensor which detects vibration of air inside the vehicle, a vibrator group consisting of a first vibrator which supports a power unit relative to the vehicle body and directly vibrates the vehicle body and a second vibrator which directly vibrates air inside the vehicle body, a detecting signal mixing means which mixes detecting signals of the first and second vibration sensors into a detecting signal, a drive control means which performs calculation on the basis of the detecting signal from the detecting signal mixing means and outputs a single drive signal to the vibrator group in accordance with the calculation which single drive signal drives the first and the second vibrators forming the vibrator group so that the vibration of the solid element and the vibration of air inside the vehicle body are damped, and a drive signal separating means with separates the single drive signal by frequency into first and second drive signals for the first and second vibrators forming the vibrator group, the first and second vibrators forming the vibrator group being driven respectively by the first and second drive signals.

28. A vibration damping system as defined in claim 27 wherein the drive signal separating means separates the signal drive signal into a low frequency signal component for the first vibrator and a high frequency signal component for the second vibrator.

* * * * *